US008342197B2

(12) United States Patent
Román et al.

(10) Patent No.: US 8,342,197 B2
(45) Date of Patent: Jan. 1, 2013

(54) BLINDS AND SHELTERS WITH FLEXIBLE AND DYNAMIC CONFIGURATIONS

(75) Inventors: Kendyl A. Román, Sunnyvale, CA (US); John Livacich, Sunnyvale, CA (US)

(73) Assignee: Evrio, Inc., Santa Clara, CA (US)

( * ) Notice: Subject to any disclaimer, the term of this patent is extended or adjusted under 35 U.S.C. 154(b) by 0 days.

(21) Appl. No.: 13/009,848

(22) Filed: Jan. 20, 2011

(65) Prior Publication Data

US 2011/0108078 A1 May 12, 2011

Related U.S. Application Data

(63) Continuation-in-part of application No. 11/295,305, filed on Dec. 5, 2005, now Pat. No. 7,766,022.

(51) Int. Cl.
*E04H 15/40* (2006.01)

(52) U.S. Cl. ..... 135/125

(58) Field of Classification Search ..... 135/124, 135/125, 120.1–120.4, 137
See application file for complete search history.

(56) References Cited

U.S. PATENT DOCUMENTS

| | | | | |
|---|---|---|---|---|
| 305,140 | A * | 9/1884 | Bradley | 285/396 |
| 2,159,273 | A * | 5/1939 | Killinger | 135/125 |
| 4,075,723 | A * | 2/1978 | Bareis et al. | 114/361 |
| 4,433,700 | A * | 2/1984 | Dohet | 135/97 |
| 5,197,504 | A * | 3/1993 | Howe | 135/127 |
| 5,385,165 | A * | 1/1995 | Hazinski et al. | 135/126 |
| 5,699,820 | A * | 12/1997 | Evans et al. | 135/96 |
| 5,823,217 | A * | 10/1998 | Rice | 135/124 |
| 5,927,311 | A * | 7/1999 | Jager | 135/124 |
| 6,415,806 | B1 * | 7/2002 | Gillis | 135/124 |
| 6,431,393 | B1 * | 8/2002 | Stewart | 220/826 |
| 6,478,038 | B1 * | 11/2002 | Le Gette et al. | 135/96 |
| 6,694,995 | B1 * | 2/2004 | Ransom | 135/128 |
| 7,607,445 | B2 * | 10/2009 | von Dewitz et al. | 135/114 |
| 2002/0020439 | A1 * | 2/2002 | Tate | 135/124 |
| 2002/0179133 | A1 * | 12/2002 | Abbinante | 135/124 |
| 2003/0000563 | A1 * | 1/2003 | Kuperman | 135/121 |
| 2004/0168715 | A1 * | 9/2004 | Wang | 135/124 |
| 2008/0053508 | A1 * | 3/2008 | Dewitz et al. | 135/124 |
| 2008/0223425 | A1 * | 9/2008 | Shumate | 135/116 |
| 2010/0275960 | A1 * | 11/2010 | Shumate | 135/116 |

* cited by examiner

*Primary Examiner* — Noah Chandler Hawk

(57) ABSTRACT

An easy to use, universal, simple, lightweight, compact, portable, dynamically configurable system of concealment and shelter. An operator configures a number of concealment blinds or shelters using shafts and covers or shells. Some embodiments include user adjustable domes. A hubless, dynamic blind or shelter comprises two or more cover shafts and an adjustable strap which provides a freestanding, flexible frame. The frame is covered with a cover or skin. The cover adjusts to the dynamic changes in the frame. In one embodiment the cover is an elastic net that changes shape but maintains tight skin. In another embodiment the cover has expansion panels and lace. Embodiments include layout blinds and boat blinds which incorporate a quick release clip 1260, and which may be used to observe or hunt waterfowl. The system includes a low cost method of tightening the skin on a cover to reduce wind movement and noise.

19 Claims, 21 Drawing Sheets

Fig. 13A
Fig. 13B
Fig. 13C
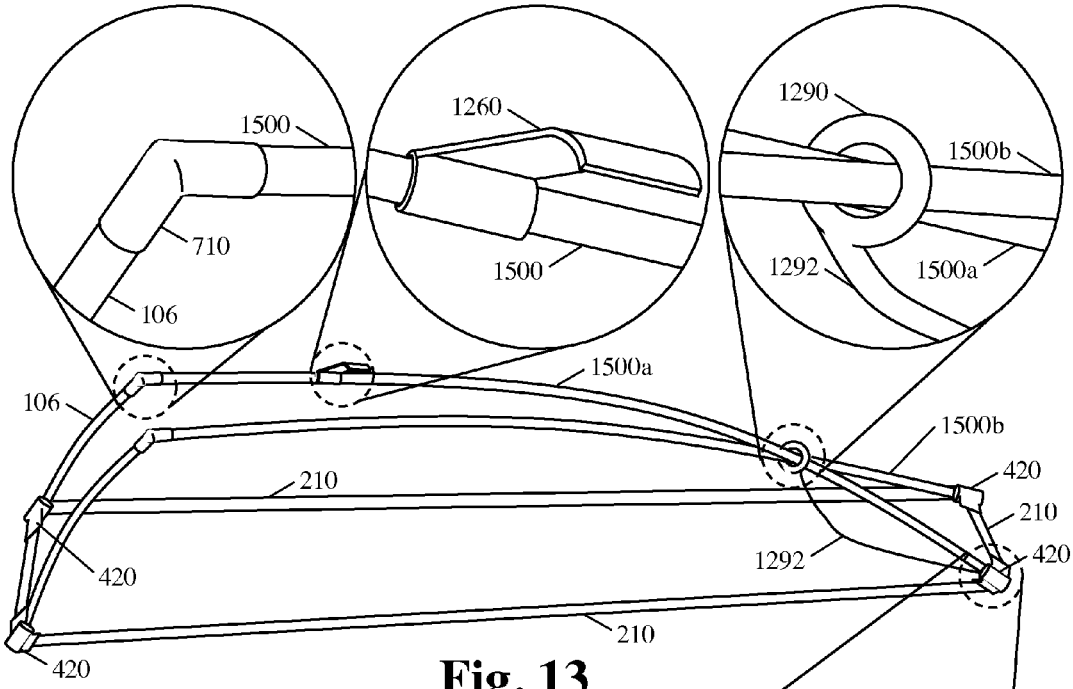
Fig. 13
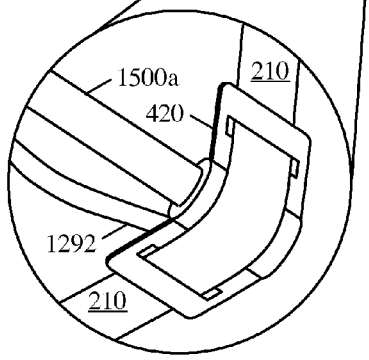
Fig. 13D

BLINDS AND SHELTERS WITH FLEXIBLE AND DYNAMIC CONFIGURATIONS

RELATED APPLICATIONS

The following summarizes related applications and patents. The subheadings are internal docket numbers and are used for shorter reference to the related application or patent.

MOC-PPA

Lightweight portable concealment means and methods

Provisional Application Ser. No. 60/295,956 Filing Date: Jun. 4, 2001

MOC1

Lightweight portable concealment means and methods

Patent application Ser. No. 10/161,986 Filing Date: Jun. 4, 2002

Publication Number 2002/0189660 Publication Date: Dec. 19, 2002

Now U.S. Pat. No. 7,100,626 Issue Date: Sep. 5, 2006

MOC2

Universal lightweight portable concealment means and methods

Patent application Ser. No. 11/045,736 Filing Date: Jan. 28, 2005

Publication Number 2005/0183761 Publication Date: Aug. 25, 2005

Now U.S. Pat. No. 7,828,038 Issue Date: Nov. 9, 2010

MOC3

Modular system for concealment and shelter

Patent application Ser. No. 11/155,398 Filing Date: Jun. 16, 2005

Publication Number 2006/0000499 Publication Date: Jan. 5, 2006

MOC4

Modular system for concealment and shelter

Patent application Ser. No. 11/295,305 Filing Date: Dec. 5, 2005

Publication Number 2006/0283491 Publication Date: Dec. 21, 2006

Now U.S. Pat. No. 7,828,038 Issue Date: Aug. 3, 2010

POLE1

Modular system including shaft segments having configuration and breakdown attachments Patent application Ser. No. 11/484,106 Filing Date: Jul. 10, 2006

Publication Number 2006/0283492 Publication Date: Dec. 21, 2006

Now U.S. Pat. No. 7,841,355 Issue Date: Nov. 30, 2010

MOC5

System for concealment and shelter with structure for rapid set up and tight skin Patent application Ser. No. 11/788,495 Filing Date: Apr. 20, 2007

Publication Number 2008/0006317 Publication Date: Jan. 10, 2008

Now U.S. Pat. No. 7,802,582 Issue Date: Sep. 28, 2010

MOC6

System for rapid concealment and shelter including angular frames and warfighter covers Patent application Ser. No. 12/290,213 Filing Date: Oct. 27, 2008

Publication Number 2009/0065039 Publication Date: Mar. 12, 2009

MOC7

Hunting Ground Blind for Rapid Concealment

Patent application Ser. No. 12/459,934 Filing Date: Jul. 8, 2009

Publication Number 2009/0272414 Publication Date: Nov. 5, 2009

Now U.S. Pat. No. 7,789,098 Issue Date: Sep. 7, 2010

MOC8

Blind with Structure for Rapid Setup

Patent application Ser. No. 12/610,887 Filing Date: Nov. 2, 2009

Publication Number 2010/0200038 Publication Date: Aug. 12, 2010

MOC2B

Universal Lightweight Portable Concealment Means and Methods

Patent application Ser. No. 12/849,008 Filing Date: Aug. 2, 2010

MOC4B

Modular System for Concealment and Shelter

Patent application Ser. No. 12/849,778 Filing Date: Aug. 3, 2010

POLE2

Blind with Structure for Rapid Setup

Patent application Ser. No. 12/955,886 Filing Date: Nov. 29, 2010

CONTINUATION AND PRIORITY CLAIMS

This application is a continuation-in-part of Ser. No. 11/295,305 filed Dec. 5, 2005, now U.S. Pat. No. 7,766,022, and claims priority based on application Ser. Nos. 11/295,305 and 11/484,106 each of which have co-pending children applications, 12/849,778 and 12/955,886 , respectively.

U.S. patent application Ser. Nos. 11/155,398 (MOC3), 11/295,305 (MOC4), and 11/484,106 (POLE1) are included herein by reference.

BACKGROUND

1. Field of the Invention

This invention relates to lightweight, portable, hubless, flexible, dynamic, concealment and shelter systems and methods.

2. Description of Prior Art

There is often a need to conceal oneself when researching wildlife, hunting, camping, working on construction projects, or working in the outdoors. Wildlife researchers conceal themselves so that they can film and study wildlife without disturbing the behavior of the animals. Hunters often conceal themselves in various hunting blinds to avoid being detected by their prey. Campers often conceal themselves to bathe, change clothes, and perform other personal or hygiene activities. Construction workers, military, law enforcement, and others who work in the outdoors also have similar needs for concealment. Various methods have been employed to accomplish these tasks.

In the past, quite complex, heavy structures have been built or constructed for concealment. Hunters have built permanent hunting blinds. Portable huts, shower stalls, dressing shelters, tents, canopies, and complex tree blind structures have been carried into the great outdoors.

The Ser. No. 11/045,736 application provided a list of patents relating to this field of invention. The discussion of these prior art references is included by reference.

The use of such devices has several disadvantages such as being heavy, bulky, noisy, expensive, awkward, and complicated to assemble or use. Most of these devices have only a single use and single configuration with poor performance. There is a need for a simple, lightweight, compact, portable, flexible, dynamic, multi-use means of concealment.

The following ground blinds are known in the art:

Hunter's Specialties' "Lightweight Portable Ground Blind"

Avery' "Avery Quick Carry Ground Blind"

U.S. Pat. No. 5,062,234, entitled "Portable Blind"

Double Bull series of five hub blinds

However, these ground blinds are limited in that they are designed for a single use or application.

Our series of single hub blinds (e.g. Ser. Nos. 11/788,495, 12/290,213, 12/459,934, 12/610,887) provide valuable improvements of the various conventional blinds. However, simpler, lower cost, more dynamic and flexible blinds are desirable.

It is also desirable to have a blind that can provide shelter from the elements. Light weight portable tents with nylon shells, rain flies, and external fiberglass poles are well known, but there have not been major innovations in basic structure and configuration of such tents in the last two decades. Each tent comes with a predetermined number of parts and is limited to a single configuration.

What is needed is a dynamic system of simple components that can be used to construct a wide variety of outdoor blinds and shelters. With such a dynamic system, the simple components can be used to create ground blinds, waterfowl blinds, blinds attached to vessels and vehicles, and various shelters.

SUMMARY OF THE INVENTION

Accordingly, it is an objective of the present invention to provide an easy to use, universal, simple, lightweight, compact, portable, quiet, flexible, multi-use dynamic system for concealment and shelter.

OBJECTS AND ADVANTAGES

Accordingly, beside the objects and advantages described above, some additional objects and advantages of the present invention are:

1. To provide a dynamic system of components that can be used construct a variety of outdoor blinds and shelters.
2. To provide a frame that can be used to create a ground blind, and waterfowl blind, by reconfiguring the same components.
3. To provide a method of tightening a skin of a blind to reduce undesired motion.
4. To provide a fully enclosed blind that allows unobstructed line of sight in 360 degrees of a substantially horizontal plane.
5. To provide an improved wildlife research blind.
6. To provide an improved hunting blind.
7. To provide improved means of construction with lower cost and longer reliability.
8. To provide a method and means of tightening the skin on the sides of a blind cover to reduce movement and flutter and ultimately reduce noise.
9. To provide a cover for a blind or shelter that can be configured in a taller position and in a lower position, while still maintaining taut cover panels.
10. To provide a cover for a blind or shelter that can be configured for different vehicles including boats and trucks.
11. To provide a cover for a blind or shelter that is dynamic.
12. To provide a cover for a blind or shelter that is modular.
13. To provide a cover for a blind or shelter that is easy to use.
14. To provide a cover for a blind or shelter that is easy to assemble.
15. To provide a cover for a blind or shelter that is easy to disassemble.
16. To provide a cover for a blind or shelter that is lightweight.
17. To provide a cover for a blind or shelter that is compact.
18. To provide a cover for a blind or shelter that is easy to transport.
19. To provide a cover for a blind or shelter that is easy to store.
20. To provide a cover for a blind or shelter that is separately packable.

These and other features and advantages of the present invention will become apparent upon consideration of the following specification, claims, and drawings.

DRAWING FIGURES

In the drawings, closely related figures have the same number but different alphabetic suffixes.

FIG. 13 (including FIG. 13A through 13D) details of an embodiment of a layout blind structure.

Figure 14:
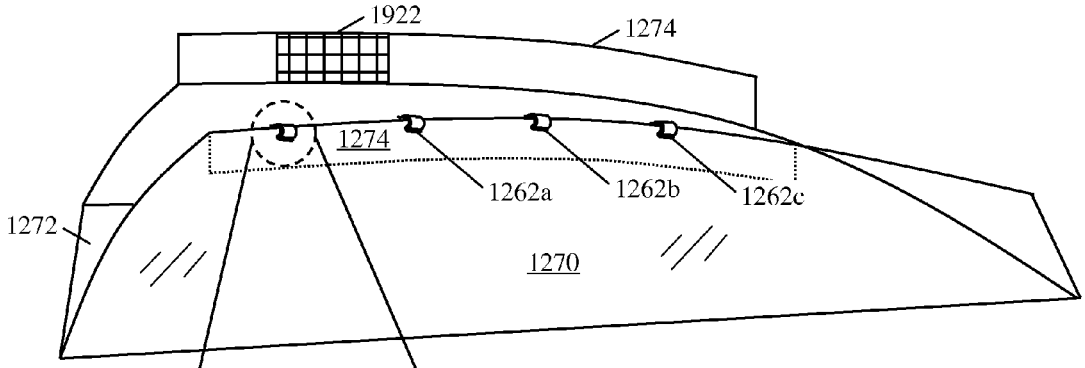

FIG. 14 (including FIG. 14A) details of an embodiment of a layout blind shell.

FIG. 15A through 15D illustrate the operation of one embodiment of a layout blind having the frame structure of FIG. 13.

Figure 16:
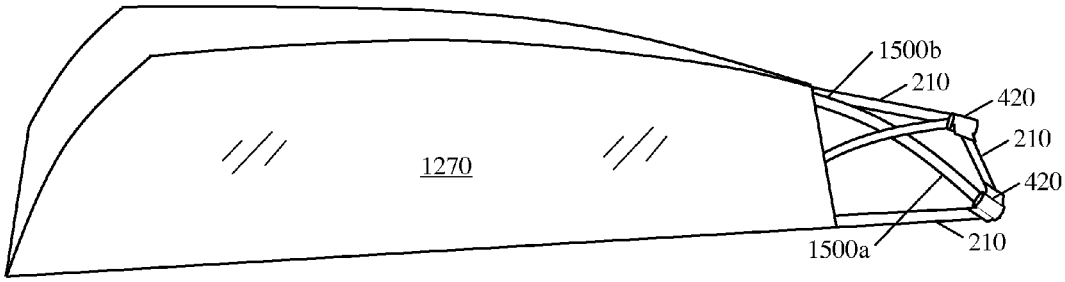

FIG. 16 illustrates an alternate embodiment of a layout blind.

FIG. 17A through 17E illustrate various configurations using hubless blind components attached to vessels and vehicles.

Figure 18A:
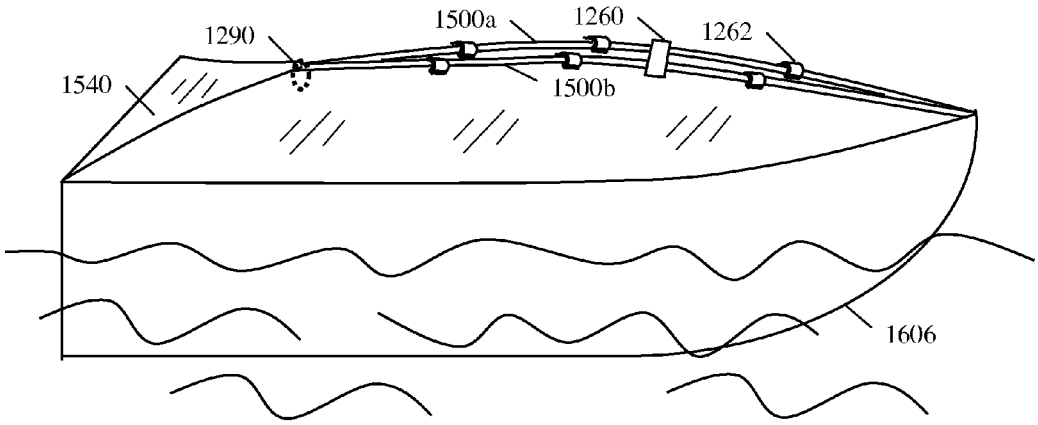
Figure 18B:
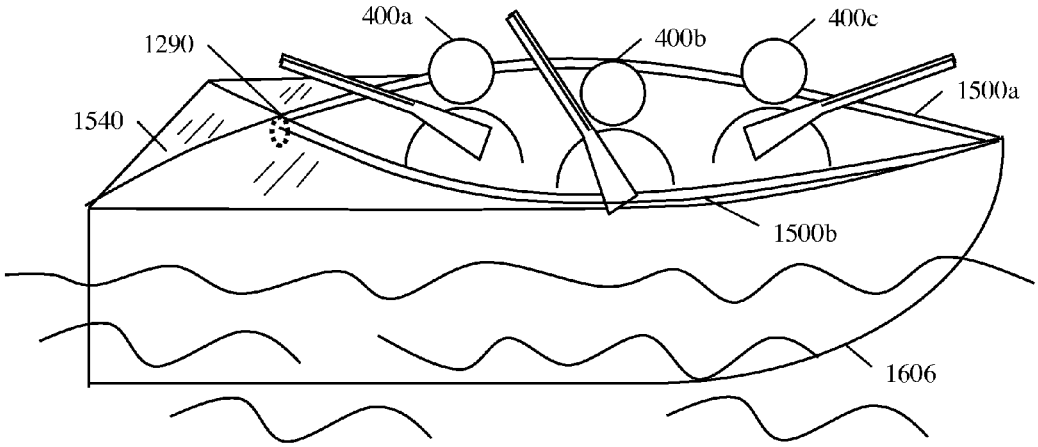

FIGS. 18A and 18B illustrate aspects of a boat blind.

Figure 19A:
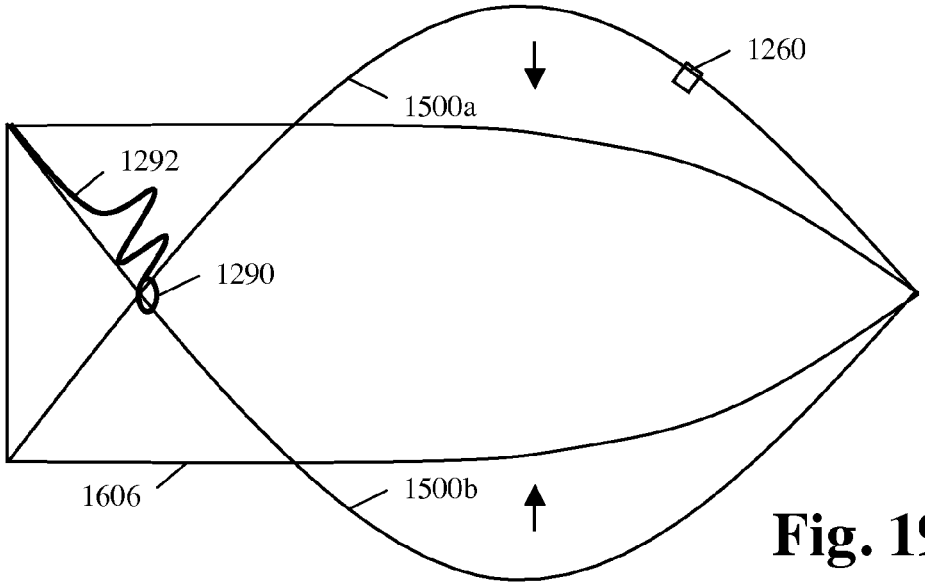
Figure 19B:
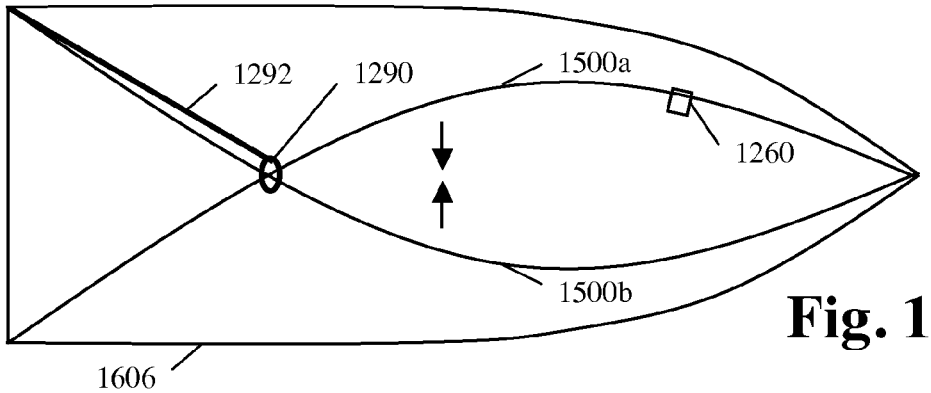
Figure 19C:
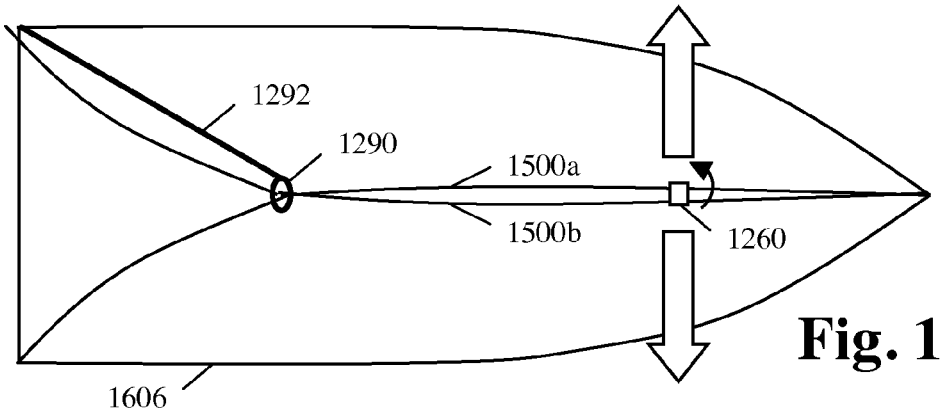

FIG. 19A through 19C illustrate the operation of one embodiment of a boat.

REFERENCE NUMERALS IN DRAWINGS

| | |
|---|---|
| 106 | shaft |
| 126 a | cord |
| 126 b | cord attachment or knot |
| 197 (a-c) | retaining dimple |
| 210 | strap |
| 212 (a-b) | strap end |

-continued

| | | |
|---|---|---|
| 230 | | sliding fastener |
| 232 | | shaft receptor |
| 234 | (a-f) | strap inlet |
| 400 | (a-b) | operator |
| 402 | | dog |
| 420 | | strap receptor |
| 430 | | adjustable strap receptor |
| 440 | | strap clip (or buckle) |
| 442 | | strap clip release |
| 710 | (a-b) | angled connector |
| 950 | | elastic net |
| 1000 | (a-d) | leaf (or scale) |
| 1001 | (a-d) | leaf attachment |
| 1070 | | inserting end (male) |
| 1072 | | receiving end (female) |
| 1250 | (a-d) | quarter section |
| 1251 | | first opening fastener |
| 1252 | | second opening fastener |
| 1253 | | third opening fastener |
| 1254 | | fourth opening fastener |
| 1256 | (a-c) | fastening point |
| 1260 | | release clip |
| 1262 | | shell clip |
| 1270 | | shell |
| 1272 | | waterproof bottom |
| 1274 | | shell overhang |
| 1280 | | backrest |
| 1282 | | doggy door |
| 1290 | | loop |
| 1292 | | limiting cord |
| 1500 | (a-b) | cover shafts |
| 1510 | | alternate cover shaft |
| 1511 | | cover shaft intersection |
| 1530 | | frame |
| 1540 | | cover |
| 1542 | (a-d) | cover panels |
| 1544 | | cover seam |
| 1578 | (a-d) | quarter section flaps |
| 1603 | | cylindrical arched roof |
| 1606 | | vessel |
| 1609 | | vehicle |
| 1644 | a | one man alternate structure |
| 1644 | b | two man alternate structure |
| 2310 | | fold |
| 2312 | (a-e) | expansion panels |
| 2314 | (a-f) | lace holes |
| 2316 | | lace |
| 3094 | | locking channel |
| 3095 | | neck |
| 3096 | | channel leg |
| 3104 | | sleeve |
| 3108 | | plain sleeve |
| 3194 | | channeled connector |
| 3196 | | rectangular pyramidal outward protrusion |
| 3197 | (a-d) | half-length shaft segment |
| 3199 | (a-l) | channeled shaft segment |
| 3500 | | pivoting intersection connector |
| 3700 | | pivoting arches |

SPECIAL DEFINITIONS cord—a flexible, and possibly elastic, filament including but not limited to a fiber, thread, string, rope, twine, wire, cable, yarn, thong, tendon, or line.

shaft—a supporting member in construction including but not limited to any solid or hollow, round or rectangular bar, beam, pole, rod, spar, or tube composed of wood, plastic, metal, or composite material.

DESCRIPTION OF THE INVENTION

The present invention comprises an easy to use, simple, lightweight, compact, portable dynamic system for concealment and shelter and methods for its construction and use.

A hubless, dynamic blind or shelter comprises two or more cover shafts 1500 and an adjustable strap 210 which provides a freestanding, flexible frame 1530. The frame 1530 is covered with a cover 1540 or skin 1272. The cover 1540 adjusts to the dynamic changes in the frame 1530. In one embodiment the cover 1540 is an elastic net 950 that changes shape but maintains tight skin. In another embodiment the cover 1540 has expansion panels 2312 and lace 2316.

Embodiments include layout blinds and boat blinds which incorporate a quick release clip 1260, and which may be used to observe or hunt waterfowl.

Figure 1A:
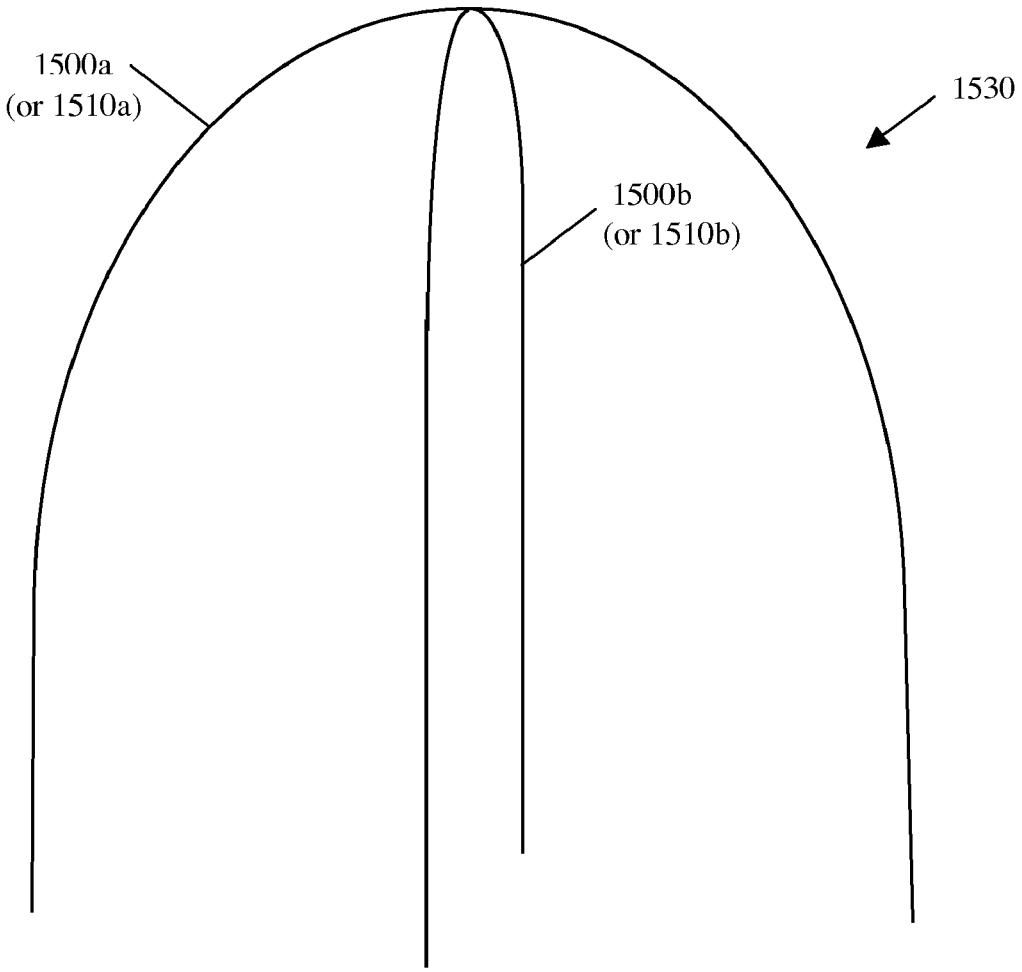
FIG. 1A through 1C illustrate various details of cover shafts of a hubless blind or shelter.
Figure 1B:
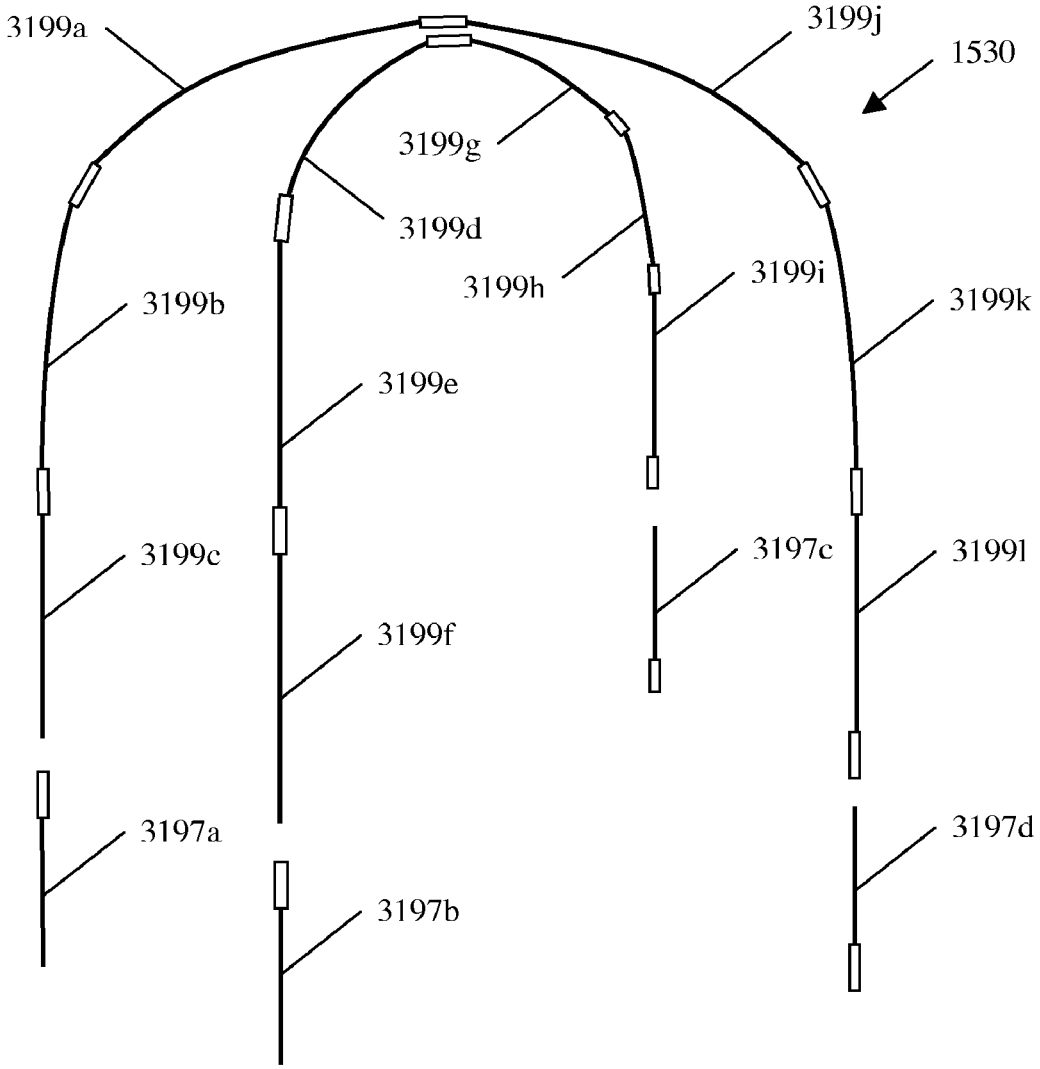
Figure 1C:
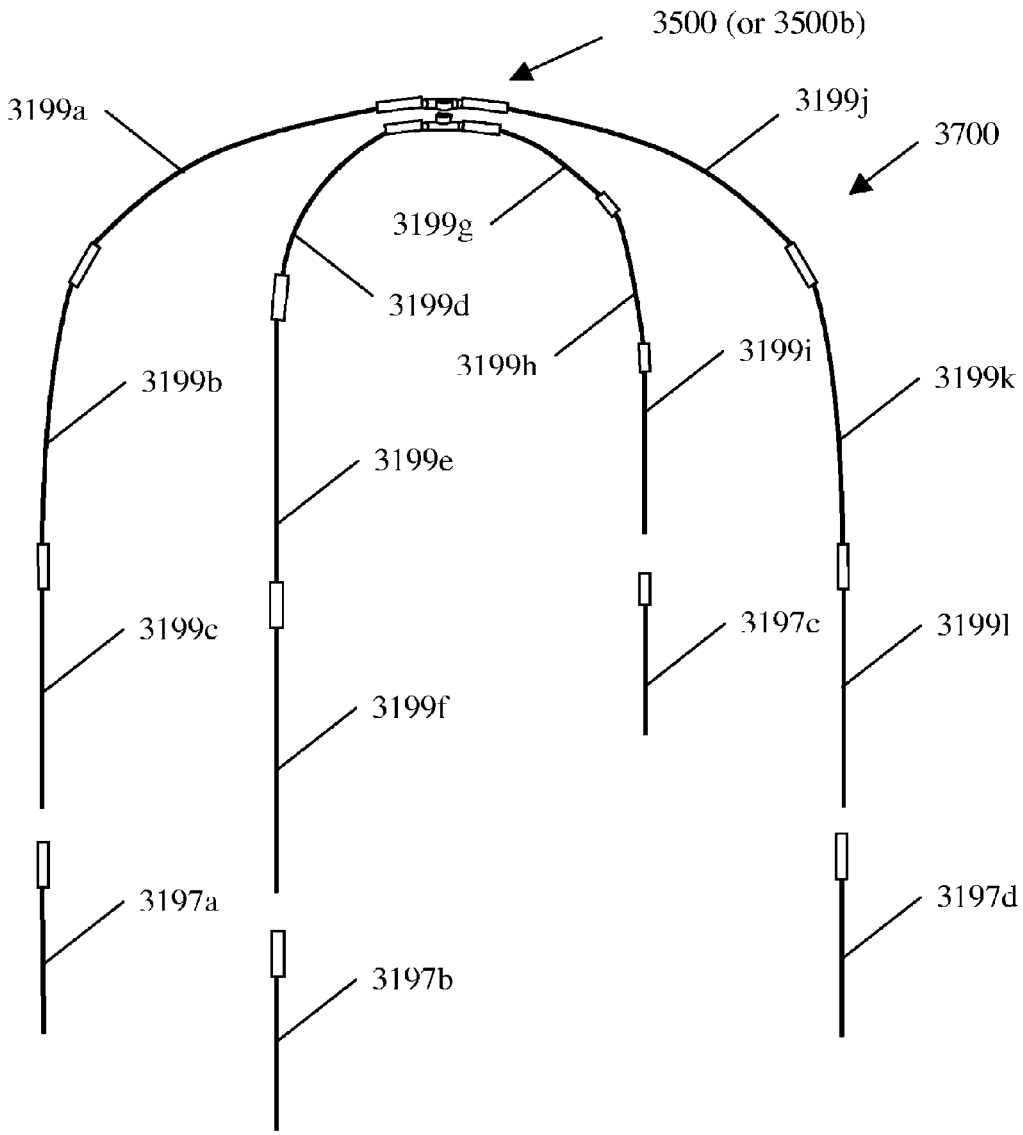

FIG. 1A Through FIG. 1C

FIG. 1A through 1C illustrate various details of cover shafts of a hubless blind or shelter.

FIG. 1A shows two cover shafts 1500 (*a-b*) forming a frame 1530. The cover shafts can be a single piece as shown.

The cover shafts can be held together with shaft intersection clip 1410 (as disclosed in the MOC4 application) or with a loop of cord 126 which is more flexible and lower cost.

FIG. 1B shows two segmented cover shafts forming a frame 1530. The segmented shafts are formed by multiple channeled shaft segments 3199 (*a-l*) and optionally half-length shaft segments 3197 (*a-d*).

In an embodiment not shown a segmented cover shaft 1500 is comprised of four cover shaft segments connected together with a cord 126*a*.

FIG. 1C illustrates a pair of pivoting arches 3700. The pair of pivoting arches 3700 comprises an embodiment of pivoting intersection connector 3500 and a plurality of full-length channeled shaft segments 3199 or half-length shaft segments 3197. In a currently preferred embodiment, the pair of pivoting arches 3700 comprises three full-length channeled shaft segments 3199 and one half-length shaft segment 3197 on each side of each arch (as shown).

FIG. 2

Figure 2:
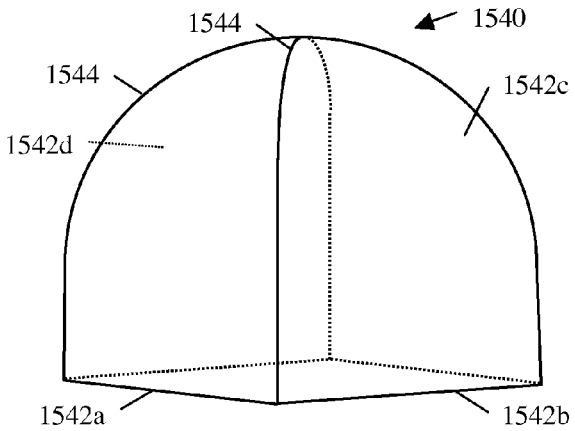
FIG. 2 illustrates details of a cover embodiment.

FIG. 2 illustrates details of a cover embodiment.

FIG. 2 shows a cover 1540 comprised of four cover panels 1542. Adjacent panels are connected together with a cover seam 1544. For example, cover panel 1542*a* is connected to cover panel 1542*b* on its right side and to cover panel 1542*d* on its left side. For concealment uses, the cover is preferably made of camouflaged material.

A novel feature of the present invention is that the cover 1540 can used to cover the shelter frame 1530. One advantage over a tent with external poles is that the cover 1540 is external to the poles, and is preferably camouflaged, so that the wildlife will not see the poles at the apex of the structure where tent poles would be most noticeable against the sky.

Another novel feature of the present invention is that the cover 1540 can be rolled up or lifted as desired because the cover is not integral to the structure of the shelter, namely the frame 1530 can stand and generally hold its shape on its own.

Figure 3A:
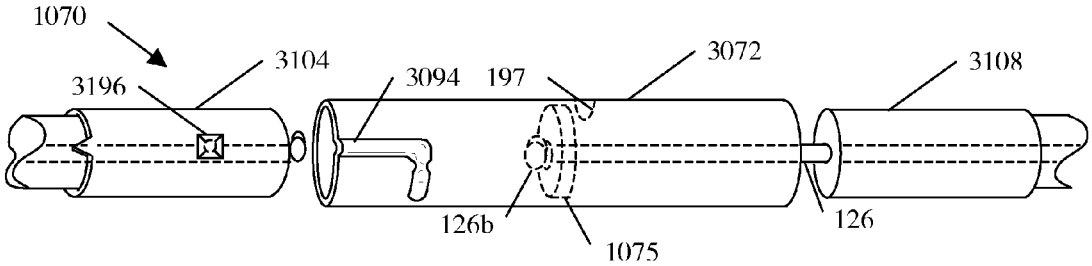
FIGS. 3A and 3B illustrate details of shaft segment interconnections.
Figure 3B:
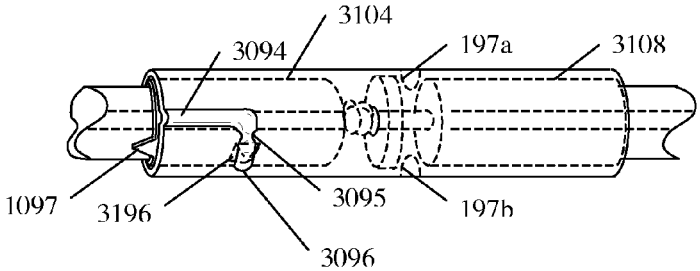

FIG. 3A and FIG. 3B

FIGS. 3A and 3B show details of shaft segment interconnections.

FIG. 3A shows a currently preferred embodiment of the interconnections of the present invention. The inserting end 1070 of the shaft 106 is protected by a sleeve 3104. The opposite end of the shaft 106 that inserts into the breakdown side of the channeled receiving end 3072 is protected with a plain sleeve 3108.

Unlike conventional pole systems where the inside diameter is approximately the same size as the outside diameter of the fiberglass pole, in this embodiment, the inside diameter of the ferrule is approximately 2.5 millimeters larger than the outside diameter of the poles (e.g. shafts 106). The separation between the metal ferrule and the fiberglass pole prevents the edge of the metal ferrule from scratching or scoring the fiberglass pole.

FIG. 3B shows a currently preferred embodiment with the configuration attachment locked and the breakdown attachment made. The outward protrusion 3196 is shown locked past the neck 3095 of the channel 3094 in the channel leg 3096. This embodiment is also shown with two retaining dimples 197*a* and 197*b*, respectively. The use of two retaining dimples 197 is currently preferred to hold the cord retainer 1075 in place. The cord retainer 1075 is preferably six millimeters in length. The cord knots are approximately six millimeters in length. The two sleeve ends are about four millimeters in length each. Thus, the space required inside the ferrule between the two fiberglass poles is approximately thirty millimeters (or 3 centimeters). The outward protrusion (3195 or 3196) and the bend forming the channel leg are both about one-half inch (or 12.5 millimeters) from the respective end. This allows each inserting end to be inserted about one inch (or 25 millimeters). A ferrule length of eighty millimeters is sufficient to make the necessary configuration connection.

FIG. 4

Figure 4:
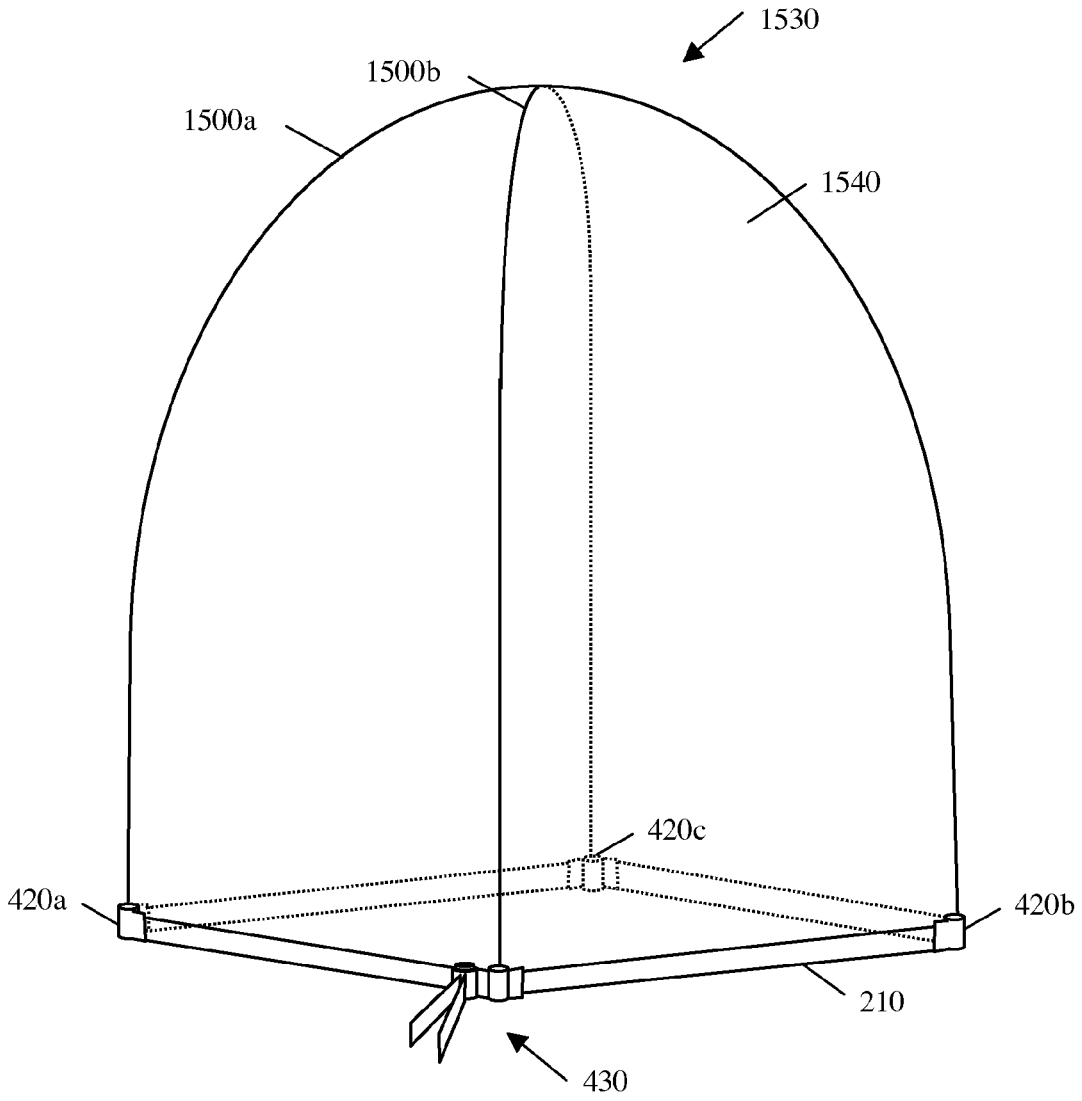
FIG. 4 illustrates a hubless, dynamic blind composed of two cover shafts and an adjustable strap.

FIG. 4 shows a hubless, dynamic blind composed of two cover shafts and an adjustable strap. Cover shafts 1500 insert into the shaft receptors 232 of the sliding fastener 230 portion of the strap receptor 420 (See FIG. 5A) or the adjustable strap receptor 430 (see FIG. 5B). A strap 210 is fed through the strap inlets 234 on the strap receptors 420 and adjustable strap receptor 430 to form the cover shafts 1500 into a dome shape. The strap clip (or buckle) 440 adjusts the slack on the strap 210.

Figure 5A:
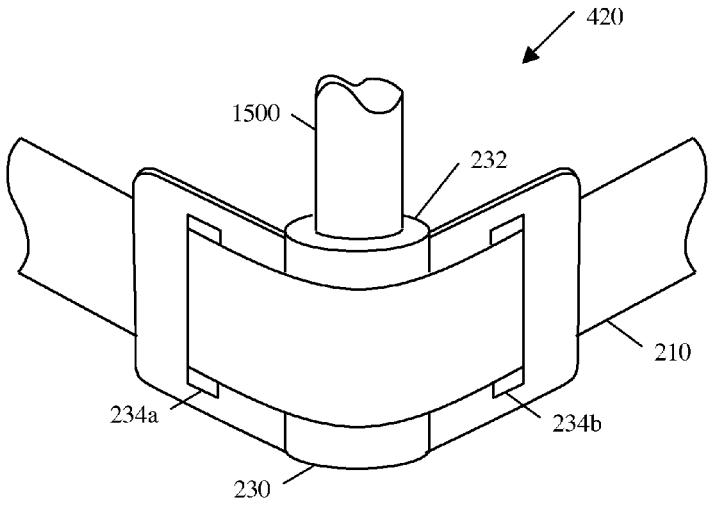
FIG. 5A through 5C illustrate details of embodiments of strap receptors, adjustable strap receptors, and strap clips.
Figure 5B:
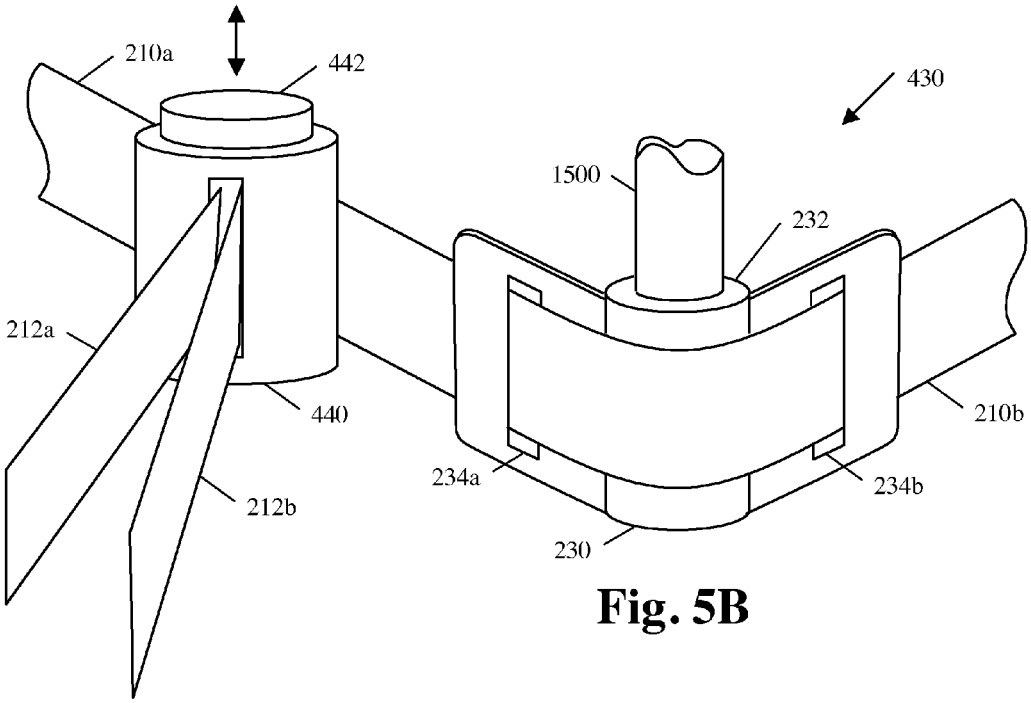
Figure 5C:
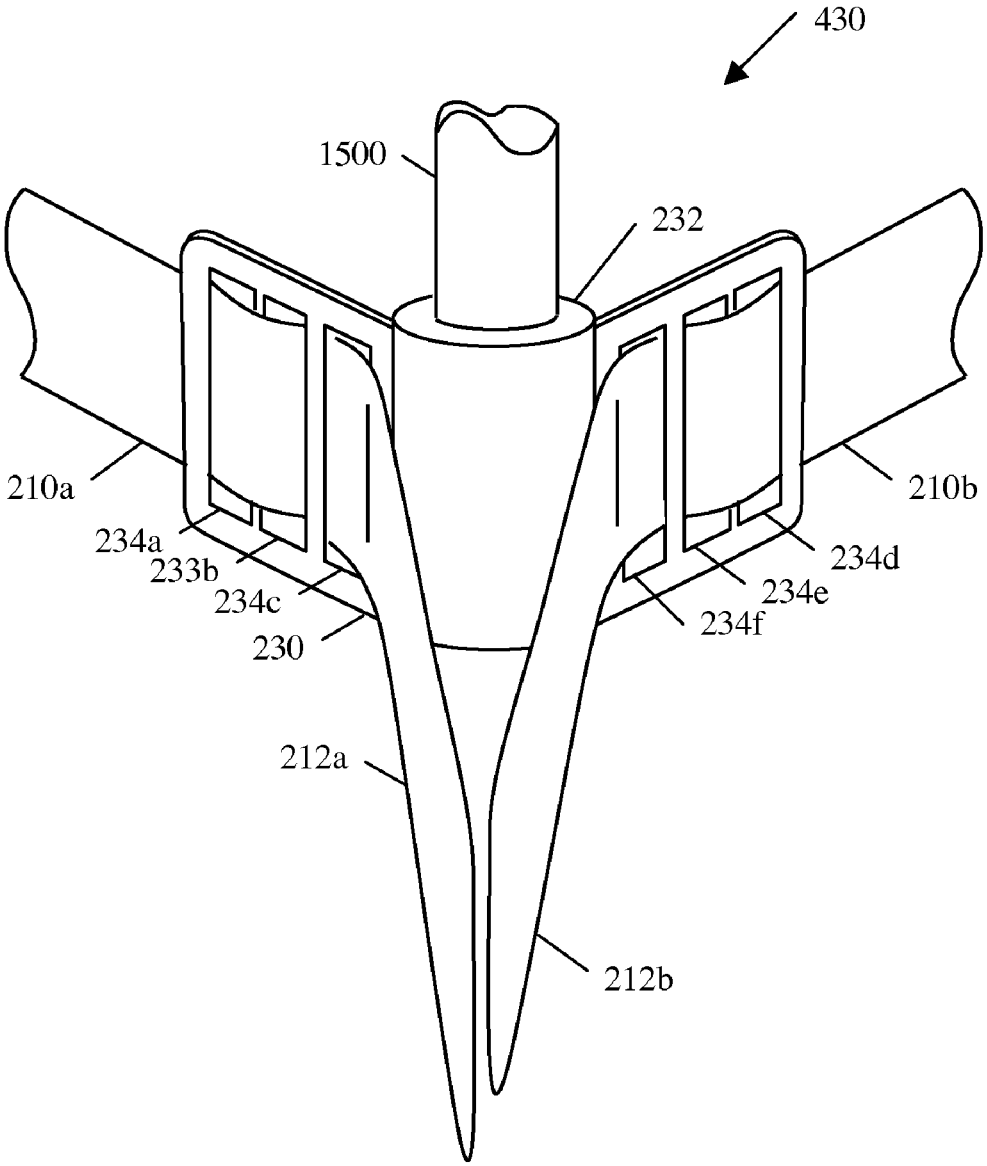

FIG. 5A Through FIG. 5C

FIG. 5A through 5C illustrate details of embodiments of strap receptors, adjustable strap receptors, and strap clips. Each embodiment allows cover shafts 1500 to be inserted into the shaft receptors 232 of the sliding fastener 230.

FIG. 5A illustrates a strap receptor 420. In this embodiment the strap 210 is weaved through the strap inlets 234 on the shaft receptor 232 providing tension to hold the strap 210.

FIGS. 5B and 5C illustrate two embodiments of an adjustable strap receptor 430 that act as end pieces in a hubless blind. FIG. 5B introduces a strap clip (or buckle) 440 with a strap clip release to adjust the slack and tighten on the strap 210. This provides a stronger hold on the strap 210 giving the dome more stability. FIG. 5C illustrates an embodiment where there are several more strap inlets 234. This inherently provides a stronger hold without the need for a strap clip (or buckle) 440.

FIG. 6A Through FIG. 6G

Figure 6A:
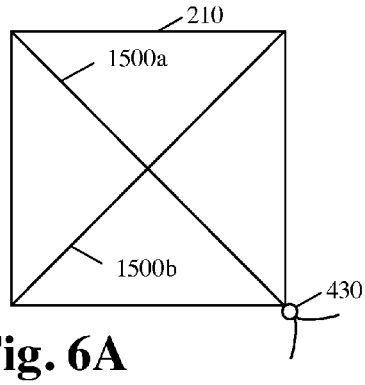
FIG. 6A through 6G illustrate the operation of one embodiment of the shelter or blind.
Figure 6D:
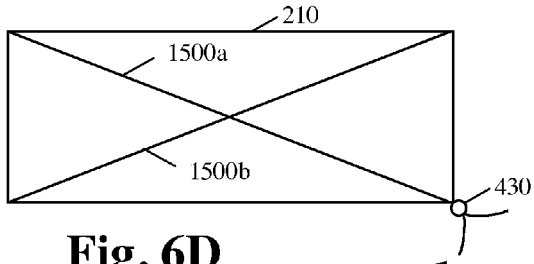
Figure 6B:
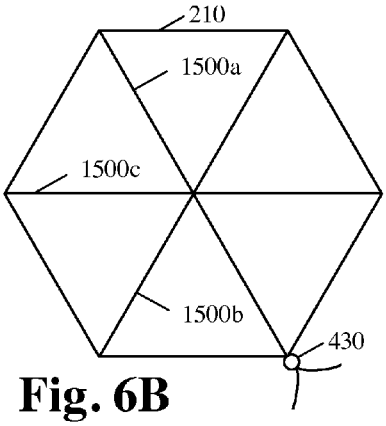
Figure 6E:
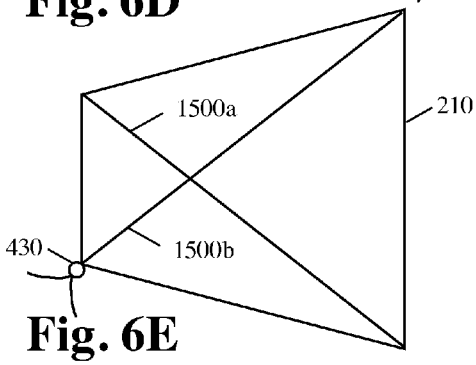
Figure 6F:
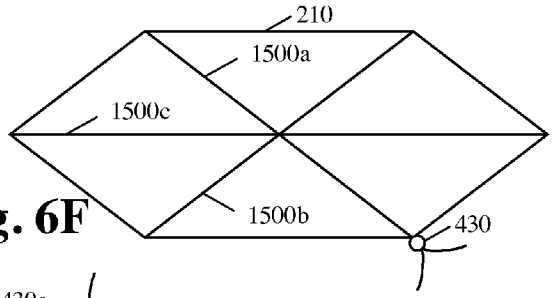
Figure 6C:
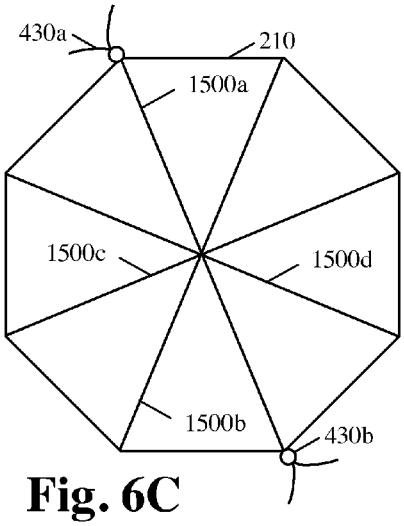
Figure 6G:
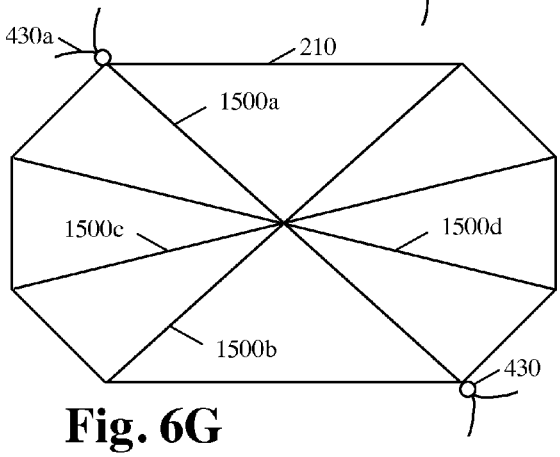

FIG. 6A through 6G illustrate the operation of one embodiment of the shelter or blind. Each comprises similar elements including two or more cover shafts 1500, one or more straps 210 and one or more adjustable strap receptors 430. FIGS. 6A, 6D and 6E illustrate two cover shaft 1500 embodiments in a square, rectangle and trapezoid configuration, respectively, with a single adjustable strap receptor 430. FIG. 6B and FIG. 6F illustrate three cover shaft 1500 embodiments in hexagon configurations with a single adjustable strap receptor 430. FIG. 6C and FIG. 6G illustrate four cover shaft 1500 embodiments in octagon configurations with dual adjustable strap receptors 430 for added adjustability.

Figure 7A:
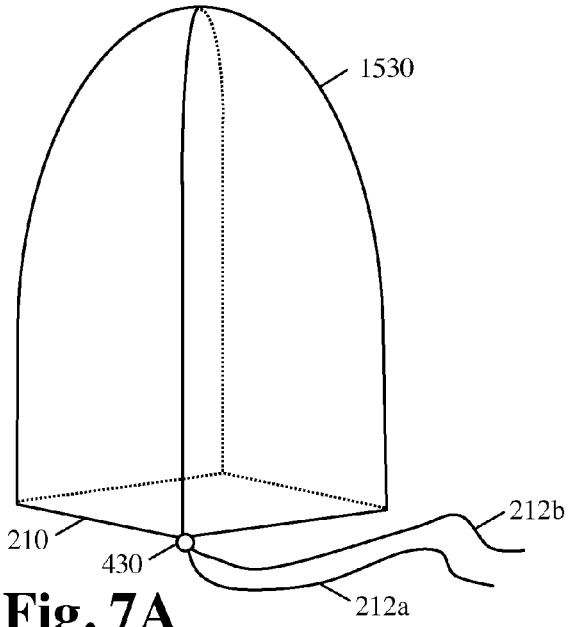
FIG. 7A through 7C illustrate the dynamic flexibility of the operation of an embodiment of a hubless blind.
Figure 7B:
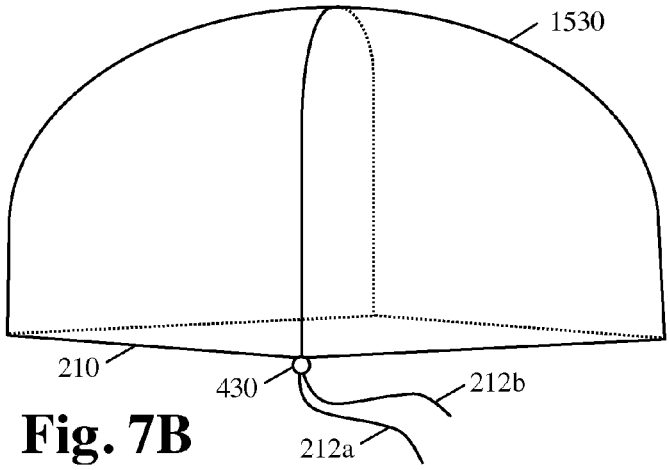
Figure 7C:
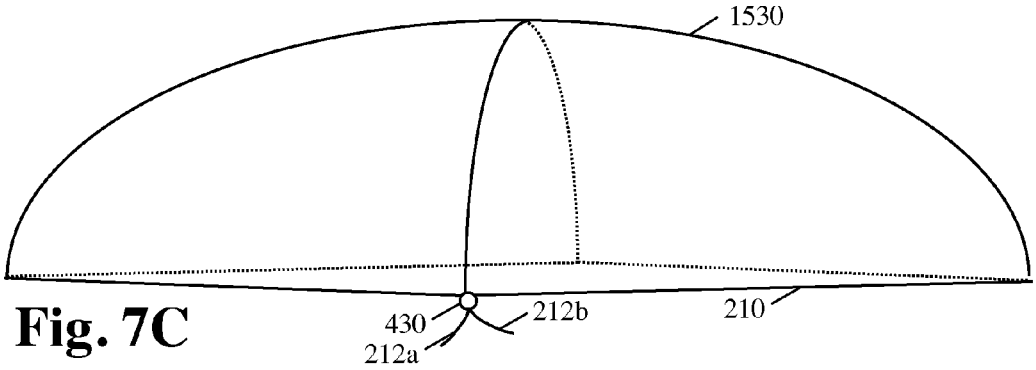

FIG. 7A Through FIG. 7C

FIG. 7A through 7C illustrate the dynamic flexibility of the operation of an embodiment of a hubless blind. The height and width of a shelter frame 1530 can be adjusted by strap 210. The longer the strap ends 212 that are pulled through the adjustable strap receptor 430, the narrower and taller a shelter frame 1530 becomes. The inverse is true for shorter strap ends 212. FIG. 7A through 7C illustrate the progression from a taller, narrower shelter frame 1530 to a lower, wider shelter frame 1530.

Dynamic Cover

The dynamic aspect of these blinds, for example, the embodiment of FIG. 4 means that a convention static cover will not work. A equally dynamic cover is needed. One solution is to have the cover made of stretch fabric, such as Lycra or Spandex brand material.

Figure 8A:
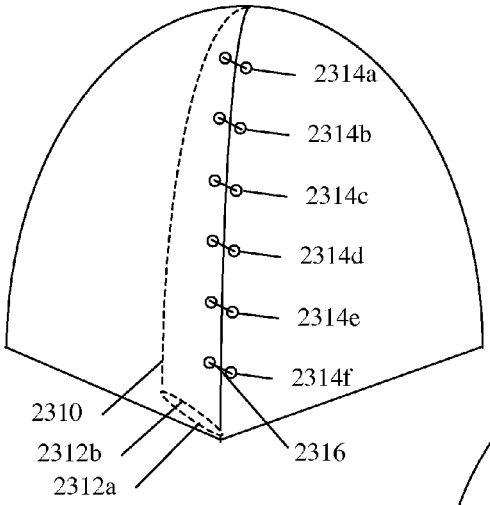
FIG. 8A through 8C illustrate covers with expansion panels.
Figure 8B:
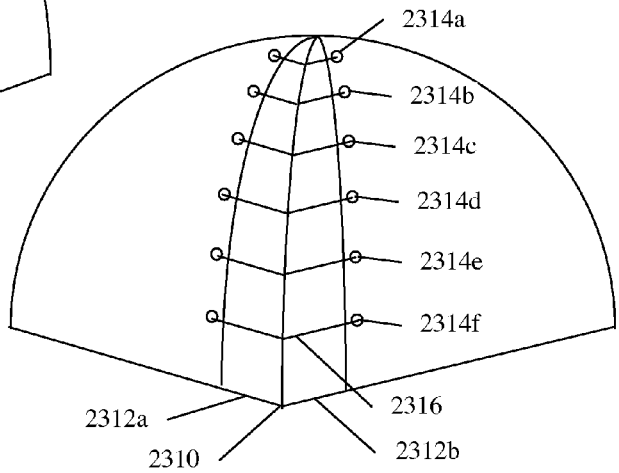
Figure 8C:
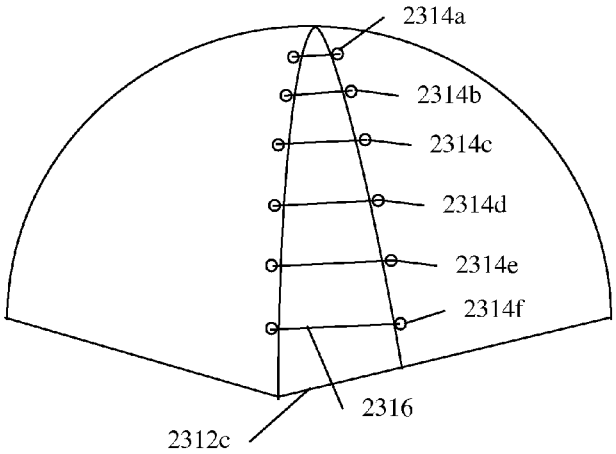

Another embodiment is shown in FIG. 8A through FIG. 8C.

Figure 9A:
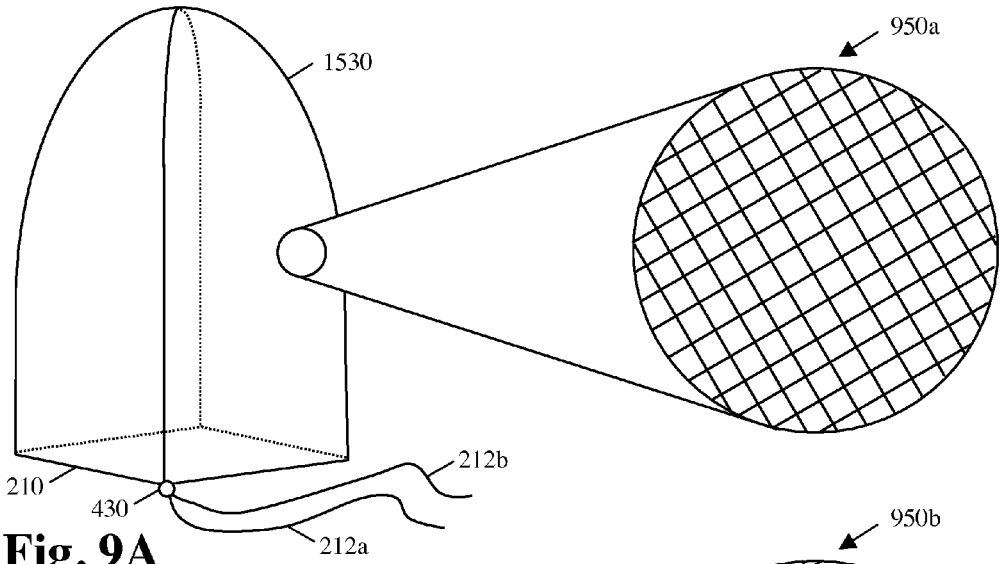
FIG. 9A through 9C illustrate the operation of an embodiment of a hubless blind with an elastic net cover.
Figure 9B:
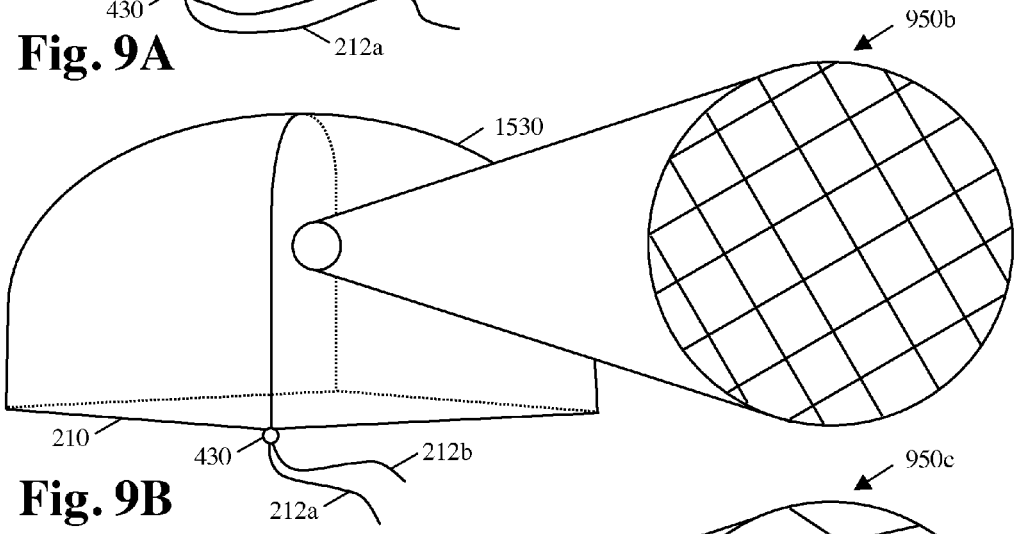
Figure 9C:
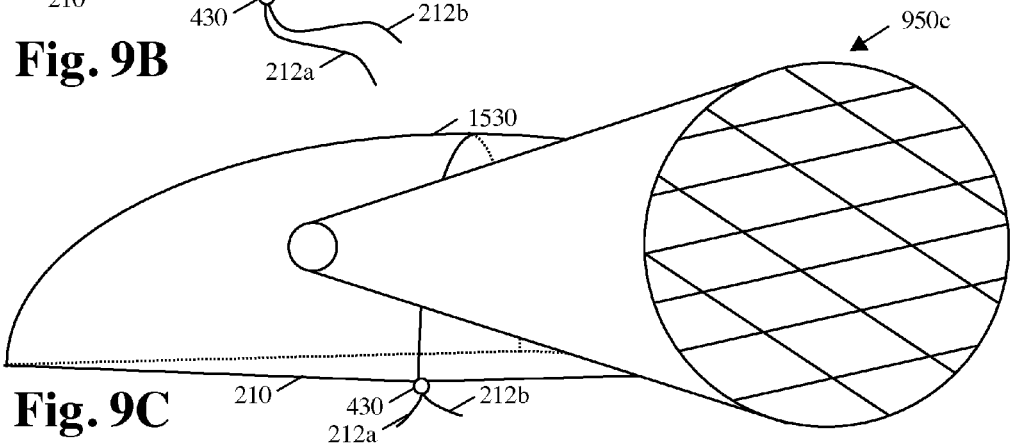

Another embodiment shown in FIG. 9A through FIG. 9C is an elastic net 950. The elastic net could be camouflaged with brush and leaves or with pieces of fabric such as shown and described with reference to FIG. 10.

FIG. 8A Through FIG. 8C

FIG. 8A through FIG. 8C show covers with expansion panels.

FIG. 8A through FIG. 8C illustrate yet another novel, optional feature. As shown FIG. 7A and FIG. 7C, the present invention allows the arches that comprises the shelter frame 1530 to be taller or to be lower. The cover 1540 needs to be able to accommodate this flexibility.

FIG. 8A shows a cover 1540 having at a fold 2310 in at least one corner. The fold 2310 brings two expansion panels 2312*a* and 2312*b* together when the shelter frame 1530 is in a taller position (see FIG. 7A) and to expand to a lower position (see FIG. 16P) as shown in FIG. 8B or alternatively FIG. 8C. The tension on the wall of the cover is maintained by passing one or more laces 2316 through pairs of lace holes. The lace could be a single cord that is drawn up, or a series of ties of for each pair of lace holes (for example, 2314*a* through 2314*f*). The laces 2314 could comprise elastic cord 126 which would be a means of maintaining a tighten force of the walls of the shelter or blind.

FIG. 8B shows the fold being released evenly on both sides of the corner shaft.

FIG. 8C shows the laces starting at the corner seam 1544 and the expansion panel 2312*c* only expanding on one side.

While a single expansion (such as the combination of 2312*a* and 2312*b* in FIG. 8B or 2312*c* in FIG. 8C) would allow for the necessary flexibility, the uniformity of the cover 1540 would be better maintained with two expanding sections of the type shown in FIG. 8B at opposite corners, or with four expanding sections of the type shown in FIG. 8C.

FIG. 9A Through FIG. 9C

FIG. 9A through 9C illustrate the operation of an embodiment of a blind with an elastic net 950 cover.

As described in FIG. 7A through 7C, FIG. 9A through 9C illustrate the effects on elastic nets 950 as a shelter frame 1530 progresses from taller and narrower to lower and wider. The elastic net 950 becomes progressively stretched in 950*a*, 950*b* and 950*c* respectively.

FIG. 10

Figure 10:
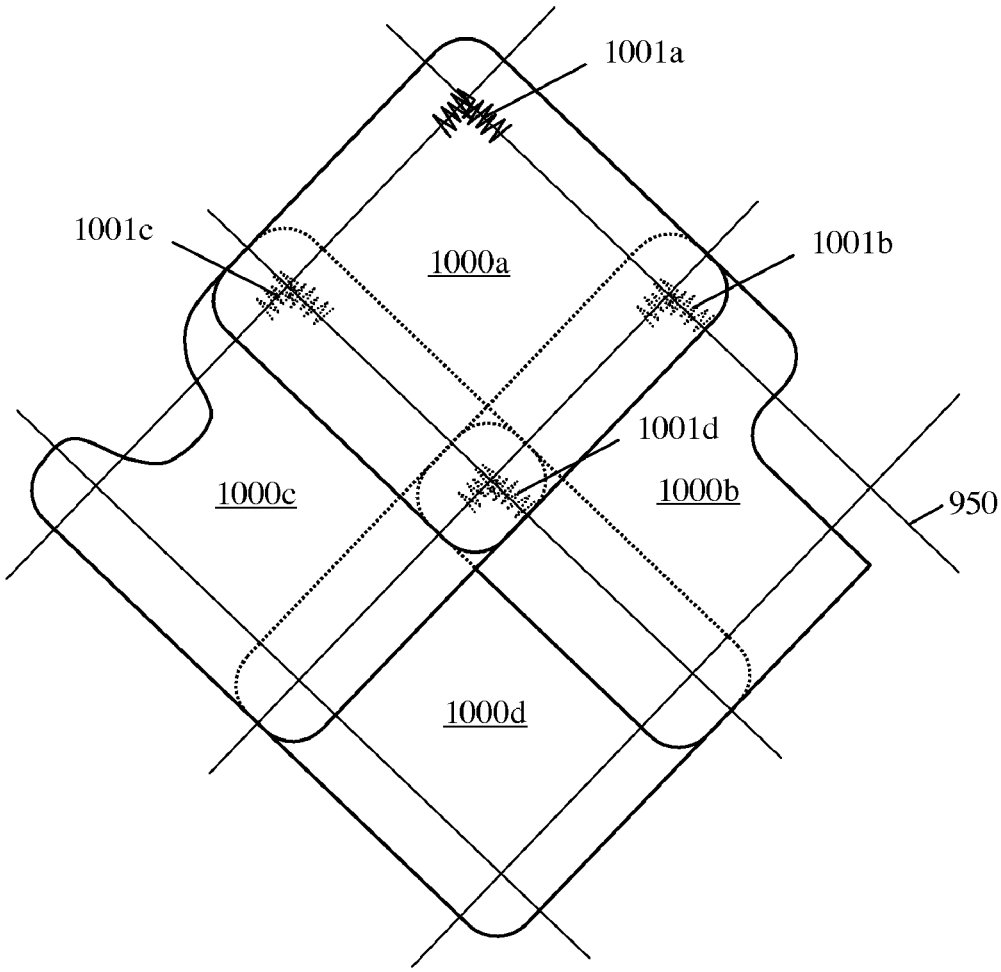
FIG. 10 illustrates details of an embodiment of an elastic net cover with overlapping leaves.

FIG. 10 illustrates details of an embodiment of an elastic net cover with overlapping leaves. Each leaf (or scale) 1000 is mounted to an elastic net 950 via a leaf attachment 1001. Each leaf (or scale) 1000 is overlapping, leaf (or scale) 1000*b* overlaps leaf (or scale) 1000*d*, leaf (or scale) 1000*c* overlaps leaf (or scale) 1000*b* and 1000*d*, leaf (or scale) 1000*a* overlaps leaf (or scale) 1000*c*, 1000*b* and 1000*d*.

A novel feature of the present invention is that, while a leaf (or scale) 1000 is overlapping and providing protection from wind and rain, it also allows for easy viewing or shooting access due to its singular leaf attachment 1001. In addition, this singular leaf attachment 1001 allows the elastic net 950 to expand and contract while allowing each leaf (or scale) 1000 to maintain its shape, position and function.

Windows

The various cover embodiments are shown without windows. The embodiments shown herein could be provided with various types of windows, such as our novel star windows (MOC4) or sliding windows (MOC5).

Modular System for Concealment and Shelter

The components described thus far provide the basic components for a blind or shelter system. These basic components can be sold as kits that can be combined with other basic kits or more advanced kits for become the building blocks for a variety of blind and shelter structures.

Advanced kits can be combined with basic kits to provide even more flexibility in constructing various blinds and shelters. One advantage of this modular system is that the operator 400 does not have to wait till he can afford the entire system. A starter kit or basic kit can be purchased first and then enhanced later without losing the initial investment. Another advantage is that a group of operators 400 can meet in the field and combine their individual basic components to form a more complex structure that meets their combined needs. For example, the more complex blinds of FIGS. 6B, 6C, 6F and 6G can be constructed by combining components for two blinds with the configuration of FIG. 6A.

FIG. 11A Through FIG. 11D

Figure 11A:
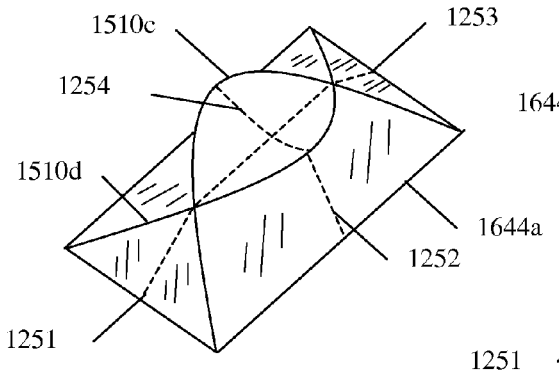
FIG. 11A through 11D illustrate other embodiments of shelters or blinds.
Figure 11B:
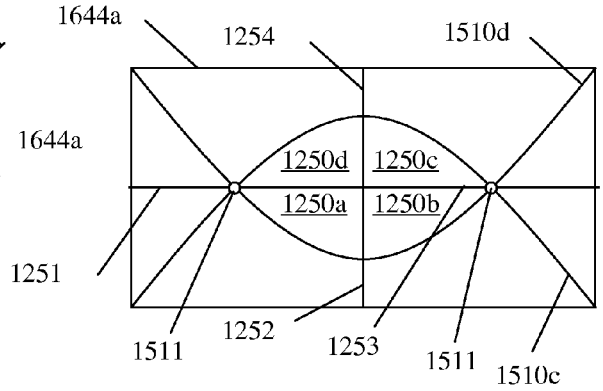
Figure 11C:
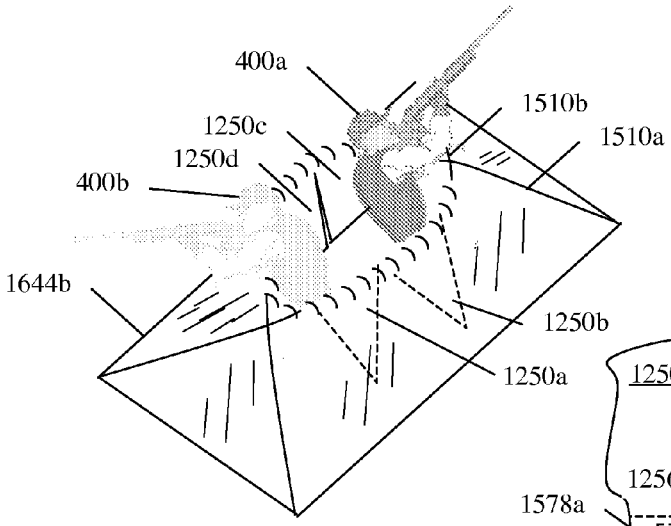
Figure 11D:
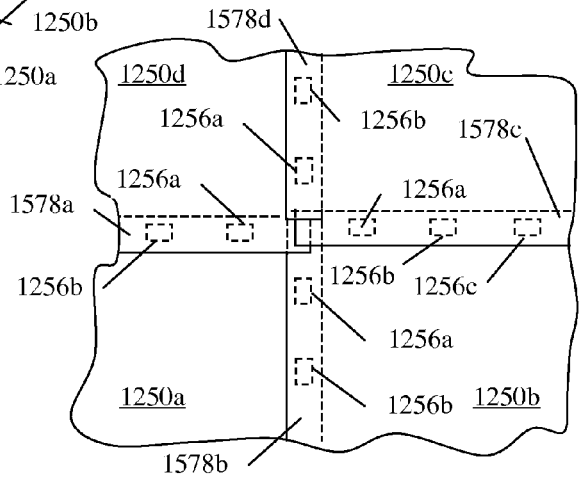

FIG. 11A and FIG. 11D show yet another embodiment of a shelter or blind having cover 1540 which is rectangular shaped at its base, namely a one-man alternate structure 1644*a*. The cover shafts are placed in the ground at an angle such that the arches (cover shafts e.g. 1510 *a-c*) lean on each other. The base forms a rectangle shape. The cover shaft intersections 1511 can be connected with ring, loop, knot, or clip, for increased stability. The top of the shelter frame (1530) formed in this way forms the shape of an "eye". This is advantageous for waterfowl hunting because the cover shafts do not cross overhead, but on the sides of the opening. In this embodiment the top of the cover 1540 has an opening made with four opening fasteners, namely, a first opening fastener 1251, a second opening fastener 1252, a third opening fastener 1253, and fourth opening fastener The Two In one embodiment, each opening fastener (1251-1254) is implemented as a zipper that completely opens to allow the cover 1540 to separate into four separate parts, i.e. quarter sections 1250*a*, 1250*b*, 1250*c*, and 1250*d*. For example the first quarter section 1250*a* is connected between the first opening fastener 1251*a* and the second opening fastener 1252, and so forth. In other embodiments the opening fasteners are made with long strips of hook and loop fasteners, or other fasteners.

In the one-man alternate structure 1644*a*, four cover shaft segments (1520) make up the cover shaft 1510*c* and another four cover shaft segments make up cover shaft 1510*d*. The cover shafts 1510*c* and 1510*d* are connected directly to the alternate supports 101. Thus in the currently preferred embodiment, the cover shafts are about 124 inches long (or just over 10 feet long). This size of structure allows a single user to lie on the ground under the structure and look up through one of the cover openings. When, for example, a waterfowl flies overhead, the user can rise up through the openings and aim handheld equipment, such as a gun or camera, at the moving wildlife.

To facilitate quick opening, a preferred embodiment further comprises quarter section flaps 1578*a* through 1578*d* that cover the respective opening fasteners (1251 through 1254). The quarter section flaps 1578 keep out rain and snow and also provide a means of holding the quarter sections 1250 together with fastening points 1265 that can be quickly opened. In the currently preferred embodiment, the fastening points 1265 are made with short strips of hook and loop fasteners. In other embodiments, the fastening points 1265 are made with snaps, buttons, clips, and so forth.

Alternatively, the frame as shown in FIG. 11A through 11B can be used with a yet another embodiment of a cover 1540 which is simply a rectangular sheet of camouflaged material thrown over the frame. In this simpler embodiment, a slit 350 (as shown if FIG. 3B) can be made in the line segment between the cover shaft intersections 511 (see FIG. 12J) and the slit 350 temporarily held together with a one or more fastening points 1256.

FIG. 11C shows a similar embodiment of a two-man alternate structure 1644*b*. In this embodiment the cover shafts 1510*a* and 1510*b* are the full length of about 187 inches including the standard supports. This size of structure allows two users to lie on the ground under the structure and look up through one or more of the cover openings. When, for example, waterfowl flies overhead, the users (400*a* and 400*b*) can rise up through the openings and aim handheld equipment, such as a gun or camera, at the moving wildlife, as shown in FIG. 11C. A portion of each quarter section 1250 is shown hanging down inside the opening after the hunters (operators 400*a* and 400*b*), for example, have burst through the top. The cover for two-man alternate structure 1644*b* is larger than, but similar in design to, the cover for the one-man alternate structure 1644*a* (FIG. 11A).

These embodiments show the flexibility and economy of the modular system of the present invention. The same hard components can be used to construct a variety of blinds using a variety of different soft components, i.e. curtains and covers 1540. Different camouflage patterns can be used to make the various curtains and covers. Examples of different camouflage patterns include woodland, grassland, marsh, desert, alpine, snow, etc.

Figure 12A:
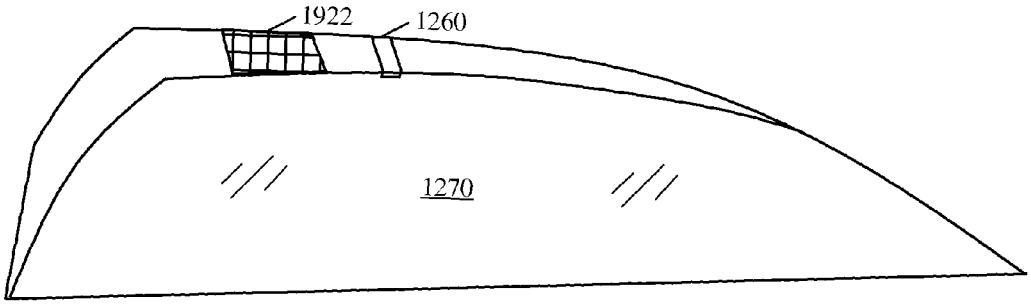
FIG. 12A through 12C illustrate aspects of a layout blind.
Figure 12B:
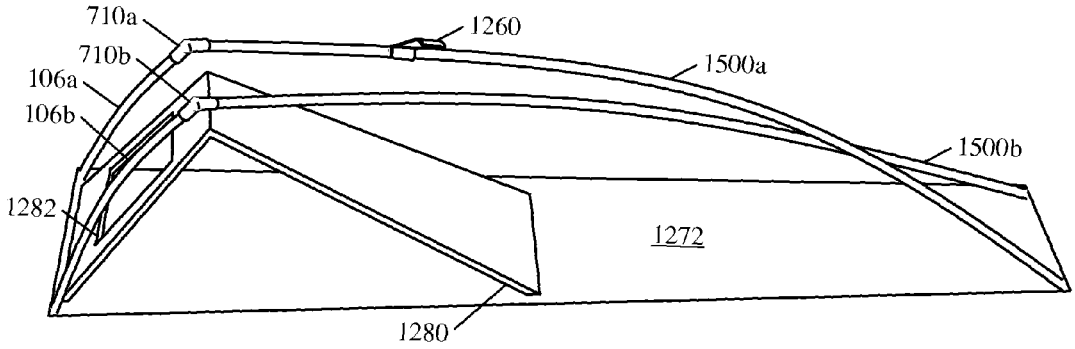
Figure 12C:
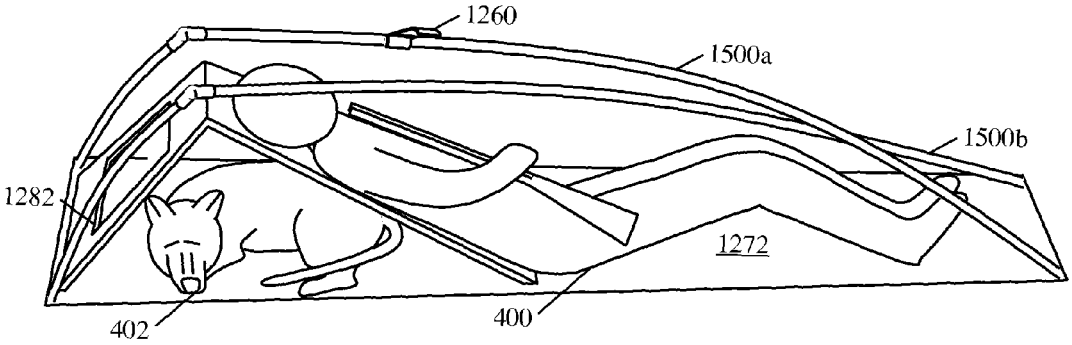

FIG. 12A Through FIG. 12C

FIG. 12A through 12C show aspects of a layout blind.

FIG. 12A illustrates an erected layout blind comprising a shell 1270, a see-through panel 1922 and a release clip 1260.

FIG. 12B shows the components of a layout blind including the cover shafts 1500, angled connectors 710, shafts 106, waterproof bottom 1272 and a release clip 1260. The cover shafts 1500 are connected through angled connectors 710 to shafts 106. The cover shafts 1500 (*a, b*) are crossed. Both the cover shafts 1500 and shafts 106 would insert into an adjustable strap receptor 430 or strap receptor 420 (both not shown) in the shape presented in the current embodiment. The angle formed is obtuse. A backrest 1280 with a doggy door 1282 can be placed inside the layout blind on the waterproof bottom 1272.

Good results have been obtained by making these connectors with aluminum alloy tubes or plastic.

Good results have been obtained by making the shaft 106 from fiberglass. Good results for the attachment between the aluminum tube to the fiberglass have been obtained by gluing, crimping or making a retaining dimple 197, as shown in the MOC4 application.

Gluing the aluminum tube to the fiberglass creates a weld that distributes the force more evenly across the fiberglass shaft; this reduces the breakdown of the fiberglass that can shatter or fray when the forces are applied to a smaller area.

FIG. 12C shows an operator 400 concealed in the layout blind. The operator 400 is resting comfortably on the backrest 1280. The operator 400 is also shown with a dog 402. A novel feature of the backrest 1280 with the doggy door 1282 is that it provides a comfortable place for the dog 402 to rest out of sight and harms way. It also facilitates an exchange of body heat between the operator 400 and the dog 402. The door can easily exit the blind, for example, after the operator 400 shoots waterfowl. Meanwhile the dog is camouflaged.

The backrest compartment can also be used for storing gear, food, equipment or game.

FIG. 13

FIG. 13 (including FIG. 13A through 13D) details of an embodiment of a layout blind structure.

FIG. 13A details the cover shafts 1500 connected through angled connectors 710 to shafts 106.

FIG. 13B details the release clip 1260 on a cover shaft 1500.

FIG. 13C details the loop 1290, with limit cord 1292, around the intersection between cover shafts 1500*a* and 1500*b*.

FIG. 13D details the cover shaft 1500 and limit cord attached to a strap receptor 420. Strap 210 is weaved through the strap receptor 420.

FIG. 14

FIG. 14 (including FIG. 14A) details of an embodiment of a layout blind shell 1270. This embodiment utilizes a shell overhang 1274 comprising a see-through panel 1922 to connect to shell 1270 via multiple shell clips 1262. A waterproof bottom 1272 is show as the bottom of the shell 1270. In a homemade embodiment, the shell 1270 could be made from waterproof tarp.

Figure 14A:
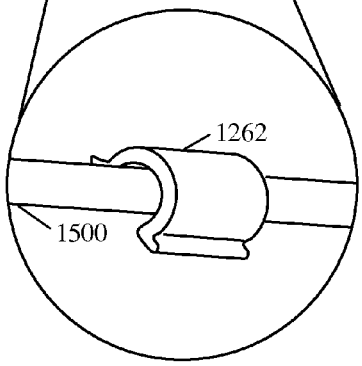

FIG. 14A details the shell clip 1262 on a cover shaft 1500. The material of the shell 1270 is flexibly attached to the cover shaft 1500. The length of the limiting cord 1292 (FIG. 13) can be adjusted to change the size and shape of the layout blind. The shell clips 1262 allow the material to be clipped to match the blind as it is dynamically reshaped.

FIG. 15A Through FIG. 15D

Figure 15A:
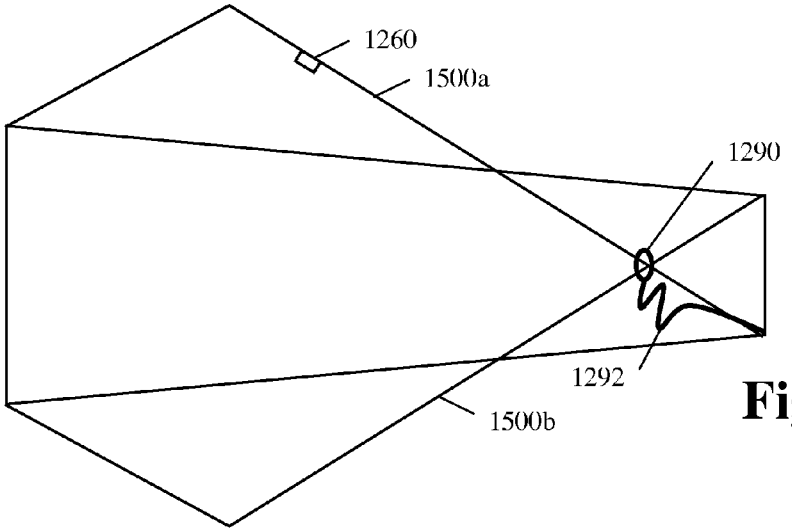
Figure 15B:
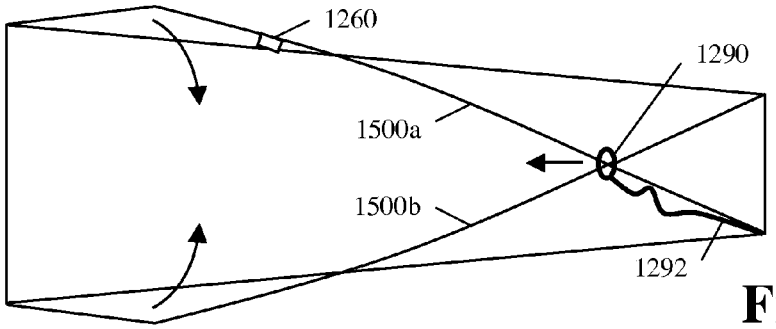
Figure 15C:
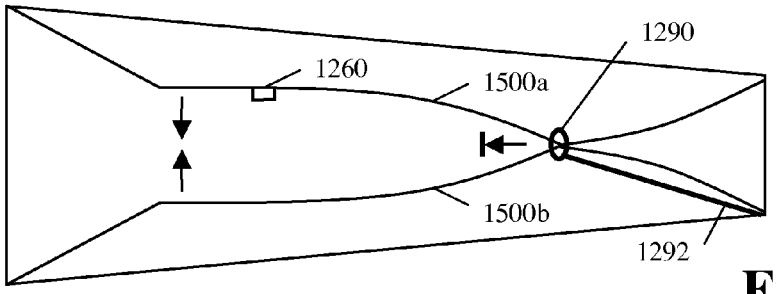
Figure 15D:
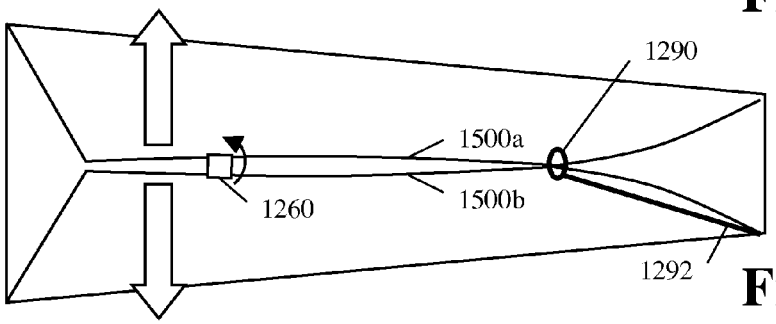

FIG. 15A through 15D show the operation of one embodiment of a layout blind having the frame structure of FIG. 13. This series shows the operation of closing and releasing (opening) a layout blind. FIG. 15A shows the layout blind fully open. As cover shafts 1500 (*a*-*b*) are pulled together they pull the loop 1290 towards the top of the layout blind (FIG. 15B) until the limit cord 1292 has reached it maximum length (FIG. 15C). FIG. 15D shows the layout blind with the top fully closed with the release clip 1260 engaged. When the release clip 1260 is released, the tension on the cover shafts 1500 (*a*-*b*) causes them to push outwards and open the top of the layout blind (FIG. 15A).

FIG. 16

FIG. 16 illustrates an alternate embodiment of a layout blind. In this embodiment, straps 210 and strap receptors 420 are used in conjunction with the cover shafts 1500 to form the layout blind.

FIG. 17A Through FIG. 17E

FIG. 17A through FIG. 17E show various configurations using hubless blind components attached to vessels 1606 and vehicles 1609.

Figure 17A:
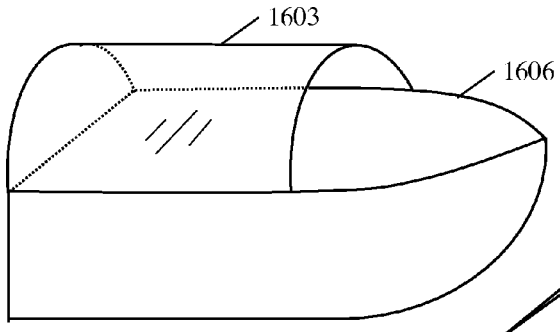

FIG. 17A shows a cylindrical arched roof 1603 mounted on a vessel 1606. The two shafts shown do not intersect and may be covered by a tarp, a sheet of camouflage material, or a camouflage netting.

Figure 17B:
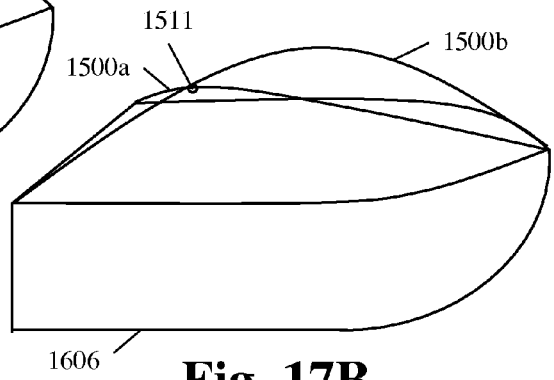

FIG. 17B shows a vessel 1606 having two cover shafts 1500 (*a*-*b*) which intersect near the rear of the vessel and meet at the bow of the vessel 106. This structure is stronger than the structure shown in FIG. 17A because the two arches are connected at the cover shaft intersection 1511.

Figure 17C:
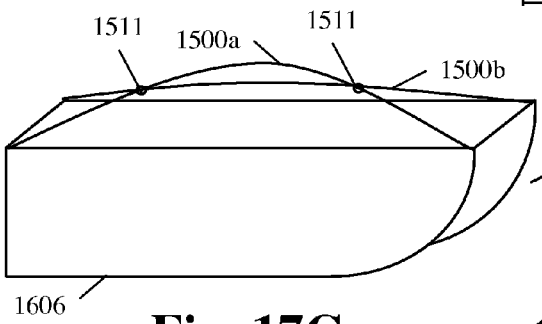

FIG. 17C shows a vessel 1606 having two cover shafts 1500 (*a*-*b*) which intersect in two places over the vessel 106. This structure is stronger than the structure shown in FIG. 17B because the two arches are connected at two cover shaft intersections 1511.

Figure 17D:
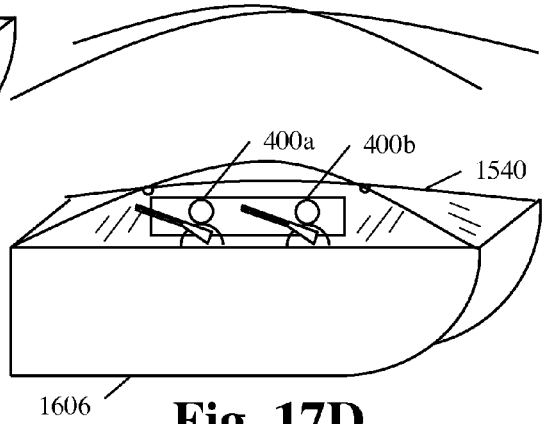

FIG. 17D shows a vessel 1606 having the structure of FIG. 17D. FIG. 17D illustrates a novel opening in the cover 1540 allowing one or more operators 400 to take aim and shoot while still being partially concealed.

Figure 17E:
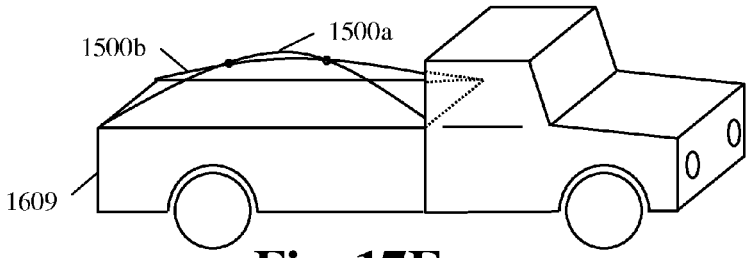

Users may want to mount a hubless blind on a vessel 1606 (FIGS. 17A through 17D, or vehicle 1609, such as a truck or ATV (FIG. 17E). Any end of a shaft (e.g. 106, 1500, 1510) is securely attached to a vessel or vehicle by attaching a strap receptor 420 to a cleat on the vessel 1606 or by attaching strap receptor 420 with industrial hook and loop fastener. These various configurations illustrate the advantages that the modular aspects of the system has over convention blinds or tents.

FIG. 18A and FIG. 18C

FIGS. 18A and 18B show aspects of a boat blind.

FIG. 18A illustrates one embodiment where cover 1540 is attached to cover shafts 1500 via shell clips 1262 (See FIG. 14) to a vessel 1606. In this figure, the boat bind is closed and the release clip 1260 is engaged. Tension is created by overlapping the cover shafts 1500 (*a*-*b*) and pulling them together until the adjustable limiting cord 1262 (FIG. 19A) limits the movement at loop 1290. The tension is held by the release clip 1260. One or more operators can be hiding inside the vessel 1606 under complete concealment of the boat blind. FIG. 18B illustrates an open boat blind allowing one or more operators 400 to take aim and shoot.

FIG. 19A Through FIG. 19C

FIG. 19A through 19C show the operation of one embodiment of a boat blind having a similar structure and operations as the structure of FIG. 13. This series shows the operation of closing and releasing (opening) a boat blind. FIG. 19A shows the boat blind fully open. As cover shafts 1500 (*a*-*b*) are pulled together they pull the loop 1290 towards the top of the boat blind until the limit cord 1292 has reached it maximum length (FIG. 19B). FIG. 19C shows the boat blind with the top fully closed with the release clip 1260 engaged. When the release clip 1260 is released, the tension on the cover shafts 1500 (*a*-*b*) causes them to push outwards and rapidly open the top of the boat blind (FIG. 19A).

Solid Shafts Versus Hollow Shafts with Elastic Cords

Some of the foregoing embodiments have explicitly shown the use of hollow shaft segments connected with an internally running cord 126. The present invention also provides a means for attaching solid shaft segments and still allowing the shafts to breakdown (see discussion in Ser. Nos. 11/295,305 and 11/484,106 applications). Most of the embodiments can be implemented with either type of segmented shaft. A solid fiberglass shaft has greater strength than the same sized hollow fiberglass shaft. By using solid fiberglass shafts, smaller diameter shafts can be used resulting in lower cost and lower volume. It is anticipated that both hollow shafts with cords and solid shafts with or without hinged connectors will be used. The different types of shafts can be color-coded, for example, black for solid and grey for hollow.

For some applications, an operator may want to use a solid shaft for every other segment in a segmented shaft. The remaining segments could be those as shown in FIG. 1B which would allow for a breakdown at both ends of the hollow shaft segments. The end result would be a stronger overall segmented shaft that would have one breakdown point per each shaft.

In applications where the segmented shaft needs to also have tensile strength, only solid poles without corded attachments would be necessary.

Other Uses

While the descriptions of the various embodiments have been made in reference to an undeveloped outdoor area, the module system of the present invention could also be used in urban areas. For example, in colder winter climates, the system could be used to form a green house over a garden using clear plastic sheeting and then reassembled in the summer as a shelter for vehicles or bicycles using an opaque tarp. In another example, the supports, shafts, connectors, and curtains could be used to form a backyard maze. In yet another example, the system could be used for constructing outdoor structures for weddings, flea markets, festivals, or even security checkpoints.

Lengths in Multiples and Integrated Features

The present invention anticipates that the various components, modules, and units will be provided in an integrated fashion. For example, shafts segments all either are the same size or be multiples of a standard unit of length. For example, in the currently preferred embodiment, the standard full length is about 31 inches and a half stick is about 15.5 inches. Applying these principles allows the users of the system to configure an unlimited number of different structures to meet the needs various situations and various sized groups. Thus, any shaft may be lengthened incrementally by that unit of length by using a segment as an extension segment.

ADVANTAGES

Dynamic

The system is dynamic. The same materials are used to configure a blind or shelter to have different height, footprint, shape, and size. Some embodiments use the same materials to create a structure that will spring open.

Modular

The system is modular. A user can begin using smaller modules with minimal investment and add more pieces or more complex modules later. A group of users can each own separate modules, which are used independently, and then construct more complex configurations when the group comes together in the outdoors.

Separately Packable

Because the various components and modules can be separated, different users in a group can carry a relatively lighter load, for example, in their backpacks. The removable floor can be removed and only the lighter components need to be carried.

Skin Tightening

The novel means of tightening the skin of the present invention provides methods and means for tightening the skin on the sides of a blind cover to reduce movement and flutter in the wind. The elastic net and covers with extensions allow a wide dynamic range of configurations while maintaining tight skin. This is done with lower cost, lighter weight, and easier to use structures.

Simple

The present invention is simple to make and use. Each component is easily made. The present invention requires little time to attach and to set up.

Easy to Use

The present invention is easy to use. To install, the operator 400 simply attaches the shafts and straps, adjusts the configuration and covers the simple frame with covers or shell. Next, a shelter frame can be assembled from shafts that can be preconfigured and quickly deployed. And then, a cover can be placed over a freestanding structure.

Lightweight

The present invention comprises a few simple parts that can easily be constructed of lightweight materials. Being lightweight is important for those who have to carry gear into the outdoors.

Compact

The present invention is compact. The support, shafts, connectors, and covers can easily be rolled together into a small bundle or placed in a slender sack. Even larger modules such as covers with cover shafts can be broken down and rolled together in relatively small bundles. This is advantageous for both storage and carrying.

Portable

The present invention is lightweight and compact allowing it to be carried long distances into the outdoors and to be used in a variety of locations. The cover 1540 and other loose parts can be placed in a novel cover bag for easy movement.

Quiet

The skin tightening features of the present invention reduces noise from wind movement or flutter.

Universal

The modular system of the present invention uses the same brackets and shafts to construct both a variety of layout blinds and boat blinds. The same parts and equipment can be used to construct configurations for different purposes and for different environments. This maximizes the user's investment in the materials and minimizes the number of items to be packed. The use of standard shaft segments and half-length extension shafts provide for a large number of configurations using the same basic components.

Lower Cost, Longer Reliability

The present invention provides a number of novel features that reduce the complexity and cost of manufacture and that increase the reliability of the parts.

Conclusion, Ramification, And Scope

Accordingly, the reader will see that the present invention provides an easy to use, simple, lightweight, compact, portable, quiet, multi-use modular system for concealment and shelter.

While my above descriptions contain several specifics these should not be construed as limitations on the scope of the invention, but rather as examples of some of the preferred embodiments thereof. Many other variations are possible. For example, other embodiments of a means of connection shaft segments could be used, such as creating threads or locking slots using a smaller, machined metal sleeve glued on the end of an inserting end of a fiberglass shaft could be used. Further, different sizes of PVC pipes could be used as shafts and connectors. The various could be used without departing for the scope and spirit of the novel features of the present invention.

Accordingly, the scope of the invention should be determined not by the illustrated embodiments, but by the appended claims and their legal equivalents.

We claim:

1. A blind for hunting or wildlife research, the blind comprising:

a) a frame comprising:

i) a first arched cover shaft, ii) a second arched cover shaft, wherein the first and second arched cover shafts each have two ends, wherein the first arched cover shaft is configured to cross over the second arched cover shaft at an intersection point between the two ends of the second arched cover shaft, iii) a base strap, iv) at least two strap receptors, each connected to the base strap, v) a release clip, attached to one of arched cover shafts, vi) a limit loop, slideably positioned over the intersection point, and vii) a limiting cord, connected to the limit loop on one end and connected to one of group of: the base strap and one of the at least two strap receptors, b) a cover skin having a predetermined shape;

wherein at least one of the two ends of the first arched cover shaft is attached to a first strap receptor of the at least two strap receptors, wherein at least one of the two ends of the second arched cover shaft is attached to a second strap receptor of the at least two strap receptors, wherein the cover skin is attached to the frame, wherein, when a center of the first arched cover shaft and a center of the second arched cover shaft are pulled together, the limit loop is moved toward the two centers until a maximum length of the limiting cord is reached, wherein the release clip removeably holds the two centers together with tension, and wherein, when the release clip is released, the tension on the first and second arched cover shafts causes two centers to move outward and open the top of the blind.

2. The blind of claim 1, wherein the cover skin comprises layout blind cover, wherein the layout blind cover comprises:

i) a waterproof bottom, and ii) a shell, connected to the waterproof bottom.

3. The blind of claim 2, wherein the shell further comprises a see-through.

4. The blind of claim 2, further comprising a third receptor and a fourth receptor, wherein the first arched cover shaft and the second arched cover shaft each comprise an angled connector and an extension shaft, wherein the extension shaft of the first arched cover shaft is attached to the third receptor, wherein the extension shaft of the second arched cover shaft is attached to the fourth receptor, and wherein the third and fourth receptors are connected to the waterproof bottom.

5. The blind of claim 4, wherein the base strap is connected to the waterproof bottom, wherein the first and second strap receptor are positioned outside the skin, wherein the skin is held up at least a foot above the waterproof bottom by the first and second arched cover shaft, whereby room is made for feet of a user.

6. The blind of claim 2, further comprising a backrest, placed on waterproof bottom.

7. The blind of claim 6, wherein the backrest provides a storage compartment.

8. The blind of claim 7, wherein the backrest further comprises a doggy door in the storage compartment.

9. The blind of claim 1, wherein the maximum length of the limiting cord is adjustable.

10. The blind of claim 9, wherein the cover skin comprises vessel cover.

11. The blind of claim 9, wherein the cover skin comprises vehicle cover.

12. The blind of claim 1, wherein the limit loop comprises a rigid ring.

13. A method of quickly opening the blind of claim 1, the method comprising the steps of:

a) pulling the center of the first arched cover shaft and the center of the second arched cover shaft together, b) causing the limit loop to slide up with the intersection point until the maximum length of the limiting cord is reached, c) clipping the release clip, and d) releasing the release clip.

14. The blind of claim 1, wherein at least one cover shaft, comprises a plurality of shaft segments.

15. The blind of claim 14, wherein a first shaft segment of the plurality of shaft segments comprises a breakdown attachment comprising an elastic cord which permanently connects a connector to a shaft, the first shaft segment comprising the connector and the shaft, and wherein the first shaft segment is removably connected with a configuration attachment to a second shaft segment of the plurality of shaft segments, wherein the configuration attachment is made between the connector of the first shaft segment and an inserting end of the second shaft segment.

16. The blind of claim 1, the frame further comprising an adjusting means for adjusting a perimeter length of the base strap, wherein the adjusting means is one of:

i) a strap clip, and ii) adjustable strap receptor, wherein two strap ends of the base strap are inserted through the adjusting means forming a base loop in the base strap, the perimeter length measuring the base loop.

17. The blind of claim 16, wherein the cover skin comprises an elastic net cover, wherein, when the perimeter length of the base strap is reduced, the elastic net cover narrows at the base, and wherein, when the perimeter length of the base strap is increased the elastic net cover widens at the base, whereby the cover skin remains taut during dynamic configuration of the blind.

18. The blind of claim 17, the elastic net cover further comprising a plurality of overlapping leaves, each leaf of the plurality of leaves being attached to the elastic net with a leaf attachment.

19. The blind of claim 16, wherein the cover skin comprises a cover with at least one extension panel, wherein the at least one extension panel is adjustable, whereby the cover skin remains taut during dynamic configuration of the blind.

* * * * *